US009004029B2

(12) United States Patent
Watanabe et al.

(10) Patent No.: US 9,004,029 B2
(45) **Date of Patent: *Apr. 14, 2015**

(54) VARIABLE VALVE ACTUATING APPARATUS FOR INTERNAL COMBUSTION ENGINE

(71) Applicant: Hitachi Automotive Systems, Ltd., Hitachinaka-shi, Ibaraki (JP)

(72) Inventors: Atsushi Watanabe, Atsugi (JP); Osamu Fujita, Atsugi (JP); Tomoya Tsukada, Ebina (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/867,708

(22) Filed: Apr. 22, 2013

(65) Prior Publication Data

US 2013/0284132 A1 Oct. 31, 2013

(30) Foreign Application Priority Data

Apr. 26, 2012 (JP) ..... 2012-100516
Jun. 6, 2012 (JP) ..... 2012-128513

(51) Int. Cl.
*F01L 1/34* (2006.01)
*F01L 1/344* (2006.01)
*F01L 1/047* (2006.01)

(52) U.S. Cl.
CPC ..... *F01L 1/34* (2013.01); *F01L 1/34413* (2013.01); *F01L 1/3442* (2013.01); *F01L 2001/0473* (2013.01); *F01L 2001/34466* (2013.01); *F01L 2001/34493* (2013.01)

(58) Field of Classification Search
USPC ..... 123/90.15, 90.17; 464/160
See application file for complete search history.

(56) References Cited

U.S. PATENT DOCUMENTS 7,938,090 B2 * 5/2011 Lancefield et al. ..... 123/90.17
8,205,587 B2 6/2012 Murata
2010/0212617 A1 8/2010 Murata

FOREIGN PATENT DOCUMENTS

JP 2010-196486 A 9/2010

OTHER PUBLICATIONS

U.S. Appl. No. 13/867,715, filed Apr. 22, 2013, Hitachi Automotive Systems, Ltd.
A. Watanabe, U.S. PTO Official Action, U.S. Appl. No. 13/867,715, filed Jul. 7, 2014, 8 pages.
A. Watanabe, USPTO Notice of Allowance of U.S. Appl. No. 13/867,715 mailed Nov. 26, 2014, 6 pgs.

* cited by examiner

*Primary Examiner* — Ching Chang
(74) *Attorney, Agent, or Firm* — Foley & Lardner LLP

(57) ABSTRACT

A variable valve actuating apparatus includes: a first rotary member which includes a rotor fixed to one of the inner cam shaft and the outer cam shaft, and a receiving chamber formed within the first rotary member, and which is arranged to be rotated in an advance angle direction or in a retard angle direction relative to the drive rotary member by a hydraulic pressure selectively supplied to or drained from the advance angle operation chamber and the retard angle operation chamber; and a second rotary member fixed to the other of the inner cam shaft and the outer cam shaft, rotatably received within the receiving chamber of the first rotary member, and arranged to be rotated relative to the first rotary member and the drive rotary member within a predetermined angle range.

16 Claims, 22 Drawing Sheets

VARIABLE VALVE ACTUATING APPARATUS FOR INTERNAL COMBUSTION ENGINE

BACKGROUND OF THE INVENTION

This invention relates to a variable valve actuating apparatus for an internal combustion engine which is configured to variably control an operation characteristic of an engine valve which is an intake valve and/or an exhaust valve of the internal combustion engine.

U.S. Patent Application Publication No. 2010/0212617 A1 (corresponding to Japanese Patent Application Publication No. 2010-196486) discloses a conventional variable valve actuating apparatus.

The above-described variable valve actuating apparatus includes two intake valves in each cylinder; an inner cam shaft integrally provided with an inner cam provided on an outer circumference of the inner cam shaft, and arranged to drive one of the intake valves; and an outer cam shaft disposed on an outer circumference of the inner cam shaft to be relatively rotated, and integrally provided with an outer cam provided on an outer circumference of the outer cam shaft, and arranged to drive the other of the intake valves. At an end portion of the inner cam shaft and an end portion of the outer cam shaft, there are integrally provided, respectively, two vane-type hydraulic actuators which are arranged in series with each other in an axial direction.

The two hydraulic actuators are arranged to relatively rotate the inner cam shaft and the outer cam shaft by a supplied hydraulic pressure, and thereby to control an operation angle of the intake valve. Moreover, the two hydraulic pressure actuators are arranged to relatively rotate the inner cam shaft and the outer cam shaft with respect to (relative to) the crank shaft, and thereby to control opening/closing timing of each intake valve.

SUMMARY OF THE INVENTION

However, in the conventional variable valve actuating apparatus, the two hydraulic actuators are integrally provided at the end portions of the inner cam shaft and the outer cam shaft, and arranged in series with each other in the axial direction. Accordingly, an axial length of the apparatus becomes long, so that a size of the apparatus becomes larger.

Moreover, the conventional variable valve actuating apparatus needs four hydraulic passages of a pair of hydraulic passages for relatively rotating the inner cam shaft and the outer cam shaft with respect to the crank shaft, and a pair of hydraulic passages for relatively rotating the inner cam shaft and the outer cam shaft. Accordingly, there is a problem that a structure of the hydraulic passages is complicated.

It is, therefore, an object of the present invention to provide a variable valve actuating apparatus arranged to control a relative rotational phase between an inner cam shaft and an outer cam shaft, to control relative rotational phases of the inner cam shaft and the outer cam shaft with respect to a crank shaft, to simplify a hydraulic passage structure to control the relative rotational phases of the inner cam shaft and the outer cam shaft with respect to the cam shaft, and to attain a size reduction of an overall apparatus.

According to one aspect of the present invention, a variable valve actuating apparatus for an internal combustion engine, the variable valve actuating apparatus comprises: an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force is transmitted from a crank shaft, and which includes an operation chamber formed within the drive rotary member; a first rotary member which includes a rotor fixed to one of the inner cam shaft and the outer cam shaft, vanes separating the operation chamber to an advance angle operation chamber and a retard angle operation chamber, and a receiving chamber formed within the first rotary member, and which is arranged to be rotated in an advance angle direction or in a retard angle direction relative to the drive rotary member by a hydraulic pressure selectively supplied to or drained from the advance angle operation chamber and the retard angle operation chamber; and a second rotary member fixed to the other of the inner cam shaft and the outer cam shaft, rotatably received within the receiving chamber of the first rotary member, and arranged to be rotated relative to the first rotary member and the drive rotary member within a predetermined angle range.

According to another aspect of the invention, a variable valve actuating apparatus for an internal combustion engine, the variable valve actuating apparatus comprises: an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force is transmitted from a crank shaft; a first rotary member including a rotor fixed to one of the inner cam shaft and the outer cam shaft, vanes separating the operation chamber to an advance angle operation chamber and a retard angle operation chamber, and a receiving chamber formed within one of the vanes, the first rotary member being arranged to be rotated in an advance angle direction or in a retard angle direction by a hydraulic pressure selectively supplied to or the drained from the advance angle operation chamber and the retard angle operation chamber; a second rotary member fixed to the other of the inner cam shaft and the outer cam shaft, rotatably received within the receiving chamber of the first rotary member, and arranged to be rotated relative to the first rotary member and the drive rotary member within a predetermined angle range; a second lock mechanism arranged to lock a relative rotation between the drive rotary member and the second rotary member or release the lock of the relative rotation between the drive rotary member and the second rotary member when the second rotary member is positioned at a predetermined position between a most advance angle position and a most retard angle position relative to the drive rotary member; a first lock mechanism arranged to lock a relative rotation between the drive rotary member and the first rotary member or release the lock of the relative rotation between the drive rotary member and the first rotary member when the first rotary member is positioned at a most advance angle position or a most retard angle position relative to the drive rotary member in a state where the second rotary member is locked with respect to the drive rotary member by the second lock mechanism; and a third lock mechanism arranged to lock a relative rotation between the first rotary member and the second rotary member or release the lock of the relative rotation between the first rotary member and the second rotary member in a state where the first lock mechanism and the second lock mechanism are locked.

According to still another aspect of the invention, a variable valve actuating apparatus for an internal combustion engine, the variable valve actuating apparatus comprises: an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force is transmitted from a crank shaft; a first rotary member fixed to one of the inner cam shaft and the outer cam shaft, arranged to be rotated relative to the drive rotary member, and to be rotated by a hydraulic pressure relative to the drive rotary member in an advance angle direction or in a retard angle direction; and a second rotary member fixed to the other of the inner cam shaft and the outer cam shaft, and arranged to be rotated relative to the drive rotary member and the first rotary member within a predetermined angle range.

According to still another aspect of the invention, a variable valve actuating apparatus for an internal combustion engine, an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force is transmitted from a crank shaft; a first rotary member which is fixed to one of the inner cam shaft and the outer cam shaft, which is arranged to be rotated relative to the drive rotary member, and to be rotated relative to the drive rotary member in an advance angle direction or in a retard angle direction, and which includes a receiving chamber formed within the first rotary member; and a second rotary member fixed to the other of the inner cam shaft and the outer cam shaft, rotatably received within the receiving chamber, and arranged to be in a state where a relative rotation of the second rotary member is fixed to the drive rotary member, and arranged to be relatively rotated together with the first rotary member relative to the drive rotary member.

BRIEF DESCRIPTION OF THE DRAWINGS

FIG. 2A shows a state in which the drive cams are the same phase. FIG. 2B shows an open angle state.

FIG. 10A is a schematic view showing a state in which the drive cam receives a spring force of a valve spring. FIG. 10B is a waveform diagram showing a characteristic of a variation of positive torque and negative torque which are acted to the cam shaft, and corresponding to FIG. 10A.

DETAILED DESCRIPTION OF THE INVENTION

Figure 1:
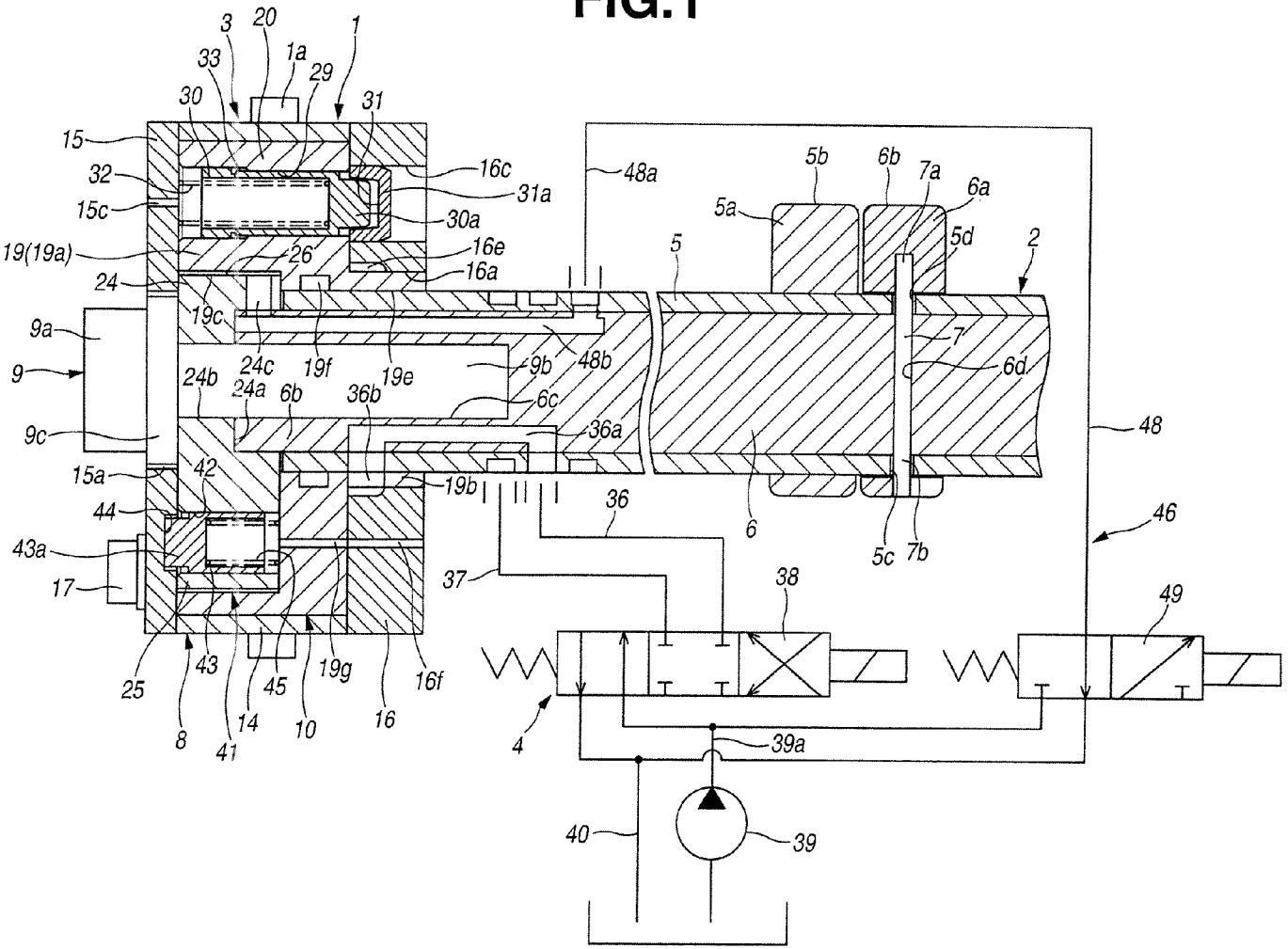
FIG. 1 is a longitudinal sectional view showing a variable valve actuating apparatus according to a first embodiment of the present invention.

Hereinafter, variable valve actuating apparatuses for an internal combustion engine according to embodiments of the present invention are illustrated with reference to the drawings. In these embodiments, the variable valve actuating apparatuses according to the present invention are applied to, for example, a four cylinder gasoline internal combustion engine.

[First Embodiment]

The variable valve actuating apparatus according to the first embodiment is applied to an exhaust valve of the internal combustion engine. This internal combustion engine includes two exhaust valves provided to each cylinder. The variable valve actuating apparatus is arranged to variably control an opening timing and a closing timing (opening and closing timings), and an operation angle (opening angle) of the both exhaust valves in accordance with a driving state (operation state) of the engine.

That is, as shown in FIGS. 1-5, the variable valve actuating apparatus includes a sprocket 1 arranged to be driven and rotated by a crank shaft (not shown) of the engine through a timing chain; a cam shaft 2 on the exhaust side (exhaust cam shaft 2) which is provided to be rotated relative to sprocket 1; a phase varying mechanism 3 disposed between sprocket 1 and cam shaft 2, and arranged to shift a relative pivot phase between sprocket 1 and cam shaft 2; and a hydraulic pressure circuit 4 arranged to actuate phase varying mechanism 3.

Figure 10A:
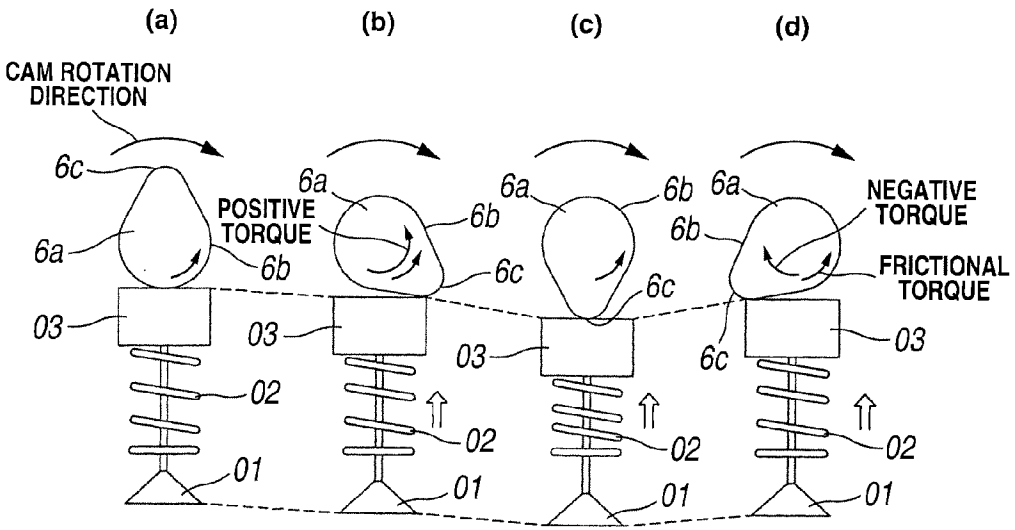
FIGS. 10A and 10B are views showing an operation principle of alternating torque generated in a cam shaft.

Each of two exhaust valves 01 and 01 of one cylinder is arranged to open and close an open end of one of two exhaust ports (not shown) of the cylinder. As shown in FIG. 10A, two exhaust valves 01 and 01 are arranged to be urged, respectively, in a closing direction by spring forces of valve springs 02 and 02.

As shown in FIGS. 1 and 2, cam shaft 2 includes a hollow outer cam shaft 5; and a solid inner cam shaft 6, which is provided within outer cam shaft 5, and which is arranged to be pivoted relative to outer cam shaft 5. Inner cam shaft 6 is rotatably supported on an inner circumference surface of outer cam shaft 5. On the other hand, outer cam shaft 5 is rotatably supported by a cylinder head (not shown) through cam bearings.

Outer cam shaft 5 is integrally provided with a first drive cam 5*a* at a predetermined position of an outer circumference surface of outer cam shaft 5 by press fit. First drive cam 5*a* is arranged to open one of the exhaust valves 01 of the one cylinder through a valve lifter 03 shown in FIG. 10A.

Inner cam shaft 6 includes an internal screw hole 6*c* which is formed in an inside of an end portion 6*b* to extend in an axial direction, and in which a shaft portion 9*b* of a cam bolt 9 is screwed. Inner cam shaft 6 is provided with a second drive cam 6*a* at a predetermined axial position. Second drive cam 6*a* is arranged to open the one of the exhaust valves through the same valve lifter 03 while sliding on the outer circumference of outer cam shaft 5.

That is, a connection shaft 7 is penetrated through and fixed in a through hole 6*d* formed in a diameter direction of inner cam shaft 6. Both end portions 7*a* and 7*b* of connection shaft 7 are fixed in second drive cam 6*a* by the press fit. With this, second drive cam 6*a* is fixed to inner cam shaft 6. Moreover, connection shaft 7 penetrates through a pair of insertion holes 5*c* and 5*d* formed in outer cam shaft 5 to penetrate through outer cam shaft 5 in the diameter direction. These insertion holes 5*c* and 5*d* are formed into elongated groove shapes extending in the circumferential direction of outer shaft 5, so as to allow inner cam shaft 6 to rotate relative to outer cam shaft 5 through connection shaft 7 within a predetermined angle range.

Figure 2A:
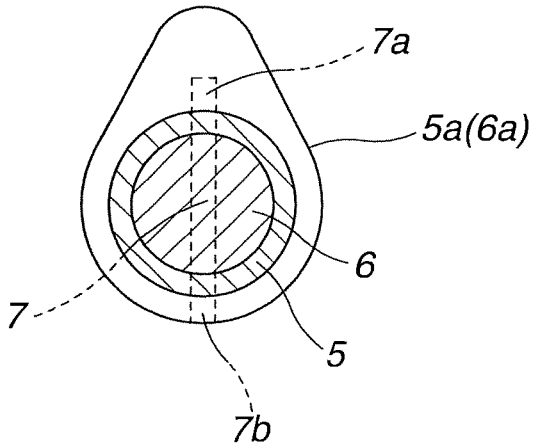
FIGS. 2A and 2B are views showing two drive cams in the variable valve actuating apparatus according to the first embodiment of the present invention.
Figure 2B:
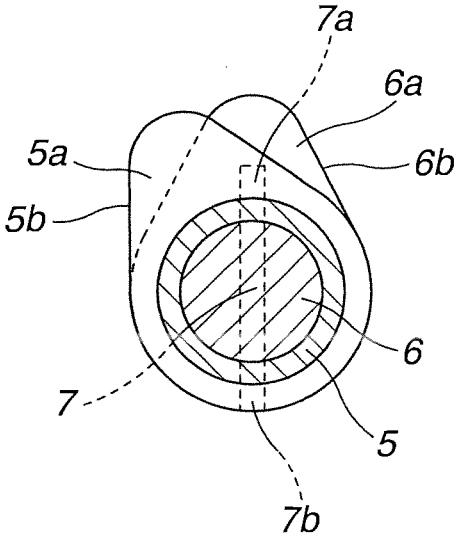

As shown in FIG. 1 and FIGS. 2A and 2B, first drive cam 5*a* and second drive cam 6*a* are disposed adjacent to each other through a minute clearance between first drive cam 5*a* and second drive cam 6*a*. First drive cam 5*a* and second drive cam 6*a* have outer circumference surfaces 5*b* and 6*b* having the same oval cam profile. First drive cam 5*a* and second drive cam 6*a* are arranged to independently open and close the one of the exhaust valves of the one cylinder.

Figure 3:
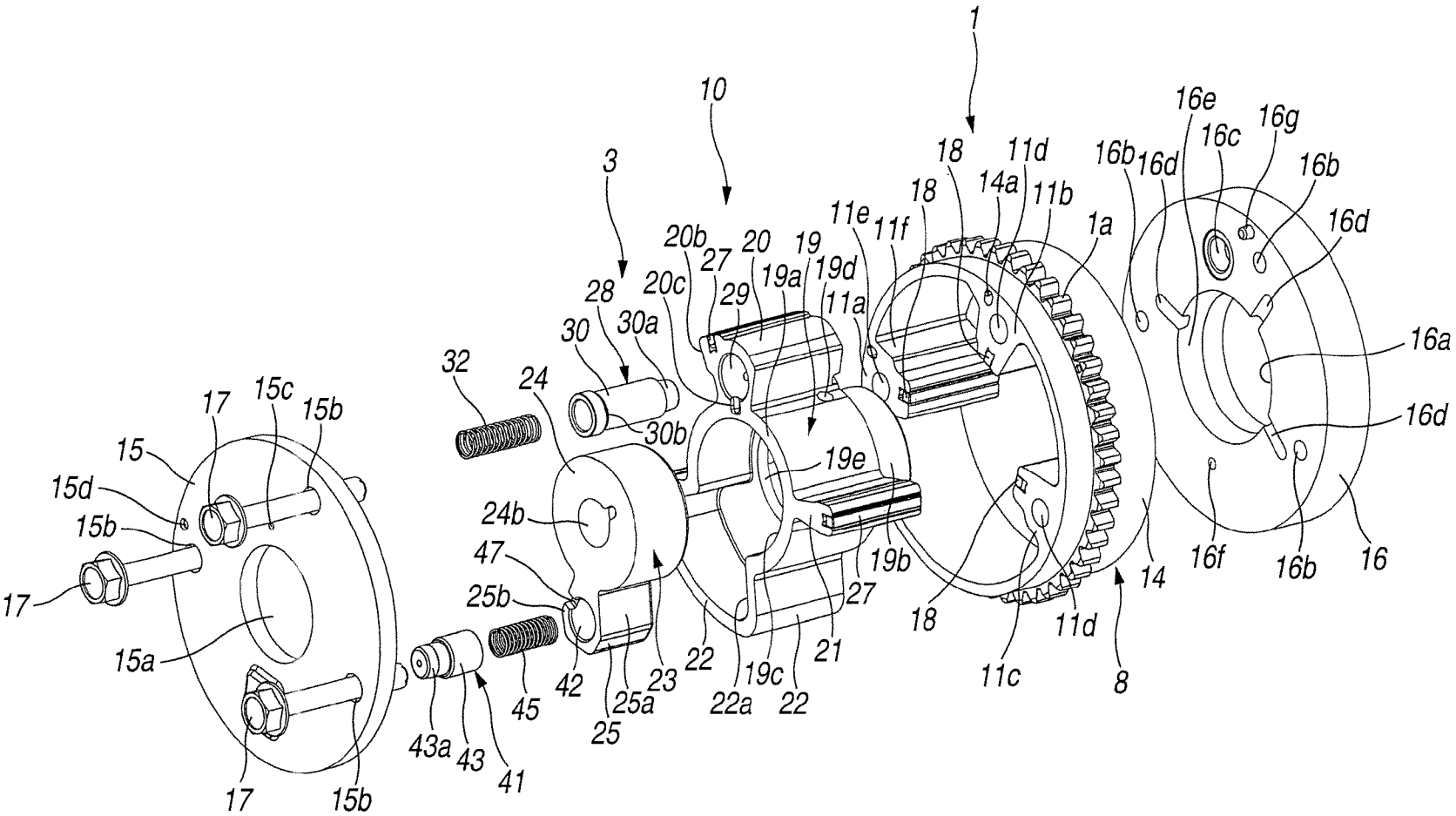
FIG. 3 is an exploded perspective view showing a main part of the variable valve actuating apparatus according to the first embodiment of the present invention.
Figure 5:
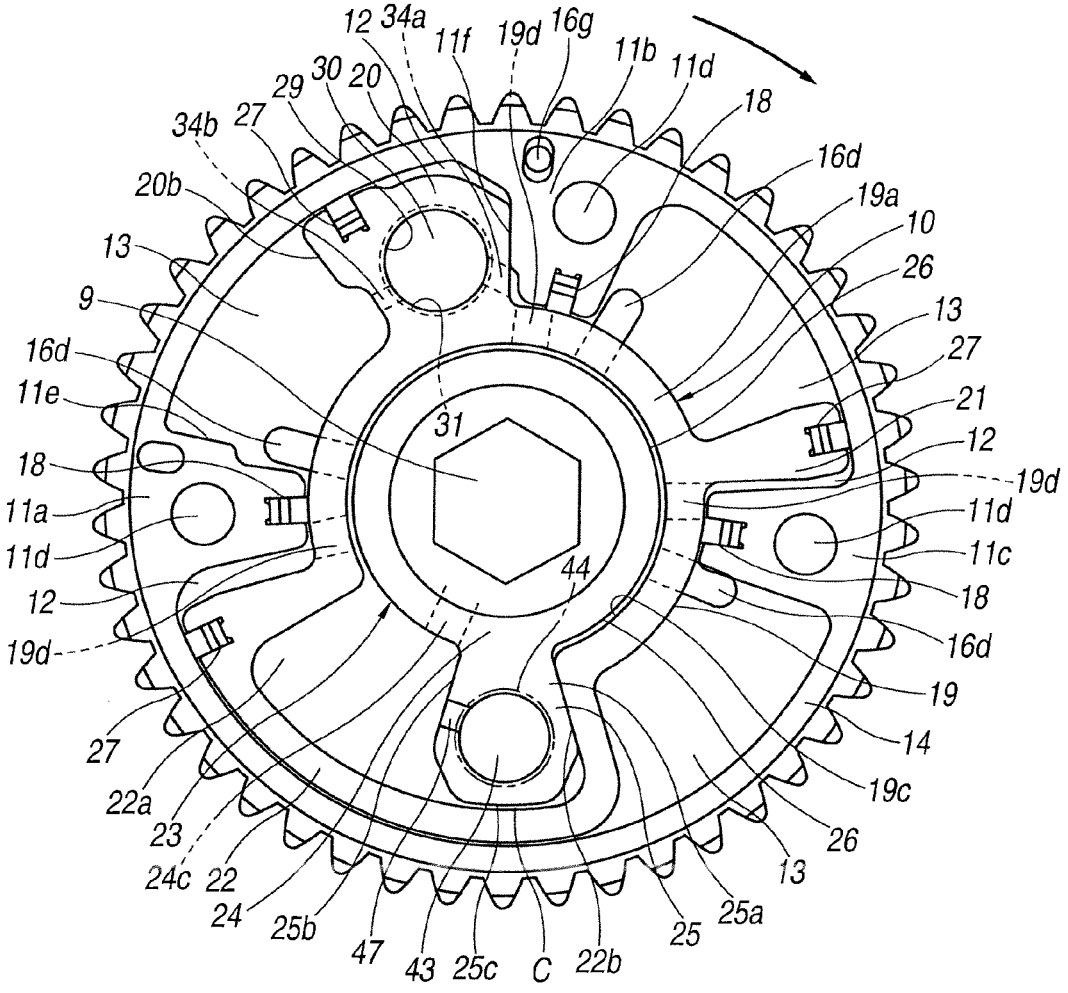
FIG. 5 is a view for illustrating an operation in a state in which a relative rotational phase of a first vane rotor relative to a sprocket is controlled to a most advance angle side in the variable valve actuating apparatus according to the first embodiment of the present invention.

As shown in FIG. 1, FIG. 3, and FIG. 5, phase varying mechanism 3 is disposed at one end portion of cam shaft 2. Phase varying mechanism 3 includes a housing 8 which is integrated with sprocket 1; a first vane rotor 10 which is a first rotary member that is fixed at one end portion of outer cam shaft 5 by cam bolt 9 from the axial direction, and that is rotatably received within housing 8; retard fluid pressure chambers 12 which are three operation chambers that are separated by three first to third shoes 11*a*-11*c* protruding from an inner circumference surface of housing 8, and three first to third vanes 20-22 (described later) of first vane rotor 10; and advance fluid pressure chambers 13 which are three advance operation chambers that are separated by three first to third shoes 11*a*-11*c* and three first to third vanes 20-22 of first vane rotor 10.

Housing 8 includes a cylindrical housing main body 14 which has openings at both axial ends, and which is shared with sprocket 1, and a front plate 15 and a rear plate 16 which close the both axial front and rear openings of housing main body 14. Front plate 15 and rear plate 16 are integrally connected with housing main body 14 by screwing together by three bolts 17 from the axial direction.

Housing main body 14 is formed from a sintered metal into a cylindrical integral body. Housing main body 14 includes a toothed portion 1*a* which is integrally formed on an outer circumference of a front end portion of housing main body 14, and around which the chain is wound; and three first to third shoes 11*a*-11*c* which are integrally formed on an inner circumference of housing main body 14, and which protrude in the inside direction.

Shoes 11*a*-11*c* are formed, respectively, into substantially trapezoid shapes as viewed from a side direction. Two shoes 11*a* and 11*c* are disposed at an interval of 180 degrees in the circumferential direction of housing main body 14. One shoe 11*b* is disposed between the two shoes 11*a* and 11*c*. Each of shoes 11*a*-11*c* includes a seal groove formed at a tip end portion in the axial direction. A seal member 18 having a substantially U-shape is mounted and fixed in the seal groove of each of shoes 11*a*-11*c*.

Moreover, each of shoes 11*a*-11*c* includes a bolt insertion hole 11*d* which is formed at an outer circumference portion (radially outer portion) of the each of shoes 11*a*-11*c*, and which penetrates through the each of shoes 11*a*-11*c*. Each of bolts 17 is inserted through one of bolt insertion holes 11*d*.

Figure 6:
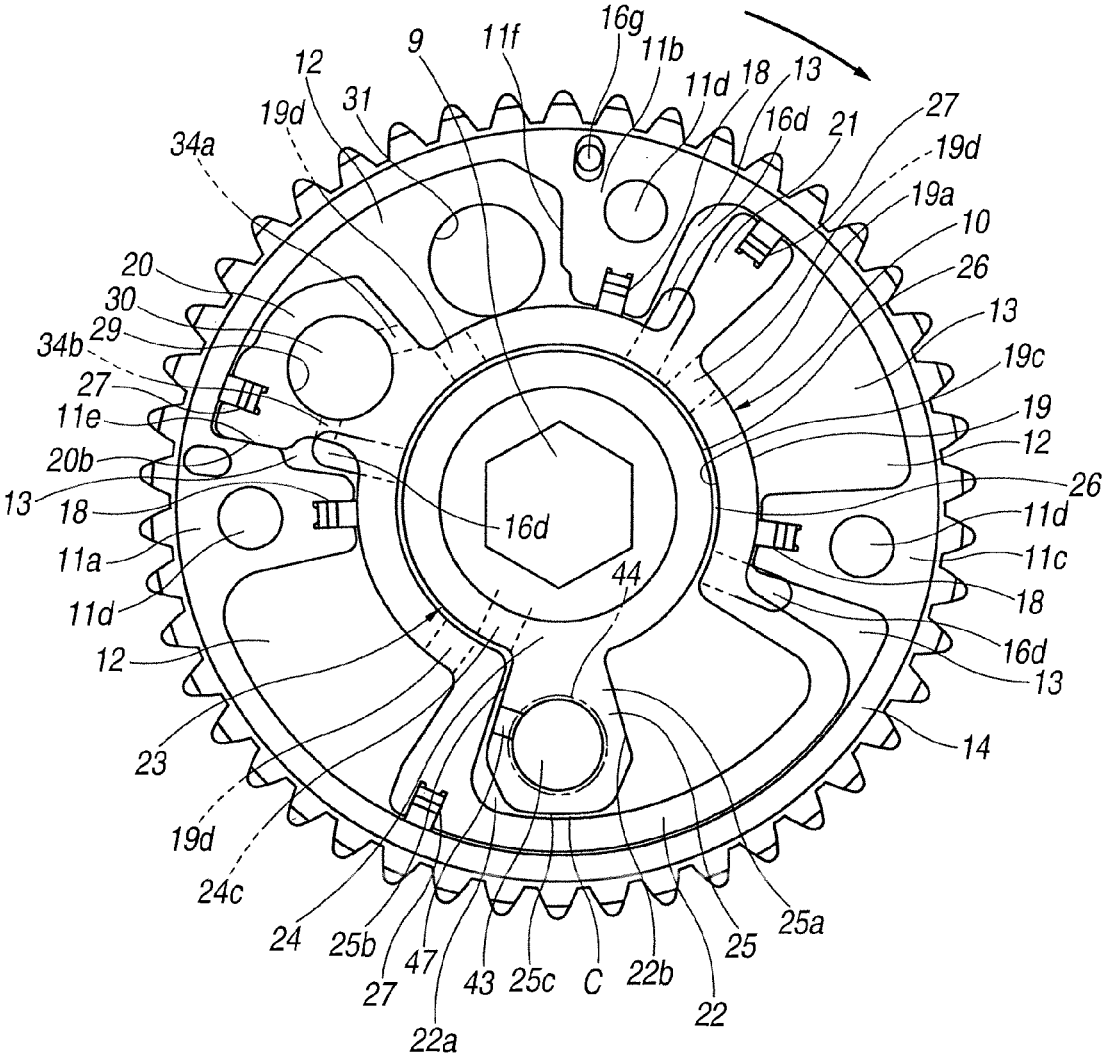
FIG. 6 is a view for illustrating an operation in a state in which the relative rotational phase of the first vane rotor relative to the sprocket is controlled to a most retard angle side in the variable valve actuating apparatus according to the first embodiment of the present invention.

First shoe 11*a* includes a flat first raised surface 11*e* which is formed on one circumferential side surface of first shoe 11*a*. On the other hand, second shoe 11*b* includes a flat second raised surface 11*f* which is formed on one circumferential side surface of second shoe 11*b* confronting the one circumferential side surface of first shoe 11*a* in the circumferential direction. When a first vane 20 described later is rotated in a clockwise direction and in a counterclockwise direction as shown in FIG. 5 and FIG. 6, corresponding surfaces of first vane 20 which confront raised surfaces 11*e* and 11*f* are abutted on these raised surfaces 11*f* and 11*e* so as to hold first vane rotor 10 at a most retard angle position and a most advance angle position.

Front plate 15 is formed by press-forming metal sheet, into a circular disc plate having relatively small thickness. Front plate 15 includes a large diameter hole 15*a* which is formed at a central portion of front plate 15, and in which a flange-shaped seat portion 9*c* of a head portion 9*a* of cam bolt 9 is disposed and received; and three bolt insertion holes 15*b* which are formed on an outer circumference side of front plate 15 at a regular interval in the circumferential direction, which penetrate through front plate 15, and each of which one of bolts 17 is inserted through. Moreover, this front plate 15 includes a breath hole 15*c* which has a small diameter, which penetrates through front plate 15, and which is formed in an inner circumference portion of front plate 15; and a positioning hole 15*d* which has a small diameter, which penetrates through front plate 15, which is formed in the outer circumference portion of front plate 15, and which is arranged to position front plate 15 with respect to housing main body 14 through a pin (not shown).

Rear plate 16 is formed from the sintered alloy into a circular disc shape having a thickness larger than the thickness of front plate 15. Rear plate 16 includes a support hole 16*a* which is formed at a central portion of rear plate 16, which penetrates through rear plate 16, into which a cylindrical rear end portion of a rotor 19 (described later) of first vane rotor 10 is inserted, and which rotatably supports the cylindrical rear end portion of rotor 19 of first vane rotor 10. Moreover, rear plate 16 includes three internal screw holes 16*b* which are formed on an outer circumference side at a regular interval in the circumferential direction, and into which external screws of the tip end portions of bolts 17 are respectively screwed.

Moreover, rear plate 16 includes a holding hole 16*c* which is formed in the outer circumference portion at a predetermined position, which penetrates through rear plate 16, and which holds and fixes a lock hole constituting portion 31*a* constituting a first lock hole 31 of a first lock mechanism 28 described later. Moreover, rear plate 16 includes three advance angle side oil grooves 16*d* each of which extends in the radial direction from an edge of support hole 16*a*; and an annular groove 16*e* which is formed on an inner circumference surface of support hole 16*a* on the front end side of support hole 16*a*, and which is connected with advance angle side oil grooves 16*d*. Advance side oil grooves 16*d* and annular groove 16*e* constitute a part of hydraulic pressure circuit 4. Advance side oil grooves 16*d* and annular groove 16*e* are arranged to supply and drain the hydraulic pressure to and from advance fluid pressure chambers 13.

Rear plate 16 includes a breath hole 16*f* which is formed in an inner circumference portion at a predetermined position, which penetrates through rear plate 16, and which is connected with a second sliding hole 42 described later; and a positioning pin 16*g* which is formed on an outer circumference portion, which protrudes toward housing main body 14, and which is arranged to position rear plate 16 with respect to housing main body 14 by being inserted into and engaged with a positioning hole 14*a* formed in second shoe 11*b* of housing main body 14.

As shown in FIGS. 1 and 3, first vane rotor 10 is integrally formed, for example, from the sintered metal. First vane rotor 19 includes a first rotor 19 on a center side, and three vanes 20-22 protruding from an outer circumference of first rotor 19 in the radial directions.

First rotor 19 is formed into a cylindrical stepped shape. First rotor 19 includes a large diameter main body 19*a* on the front end side (the front plate 15's side), and a small diameter cylindrical portion 19*b* on the rear end side (the rear plate 16's side). First rotor 19 is constituted by integrating large diameter main body 19*a* and small diameter cylindrical portion 19*b*.

This large diameter main body 19*a* includes a cylindrical rotor receiving space 19*c* which is formed within large diameter main body 19*a*, and which has a relatively large diameter. This rotor receiving space 19*c* is connected with an inside of third vane 22 described later. Moreover, large diameter main body 19*a* includes three retard side oil holes 19*d* which are formed at base end portions of large diameter main body 19*a* that are connected with vanes 20-22, which penetrate through large diameter main body 19*a* in the radial directions, and which are connected with retard fluid pressure chambers 12. These retard side oil holes 19*d* constitute a part of hydraulic pressure circuit 4.

Small diameter cylindrical portion 19*b* is fixed by the press fit on a tip end portion of outer cam shaft 5 through an inner circumference surface 19*e* of first vane rotor 19. Moreover, small diameter cylindrical portion 19*b* includes an annular groove 19*f* formed on an inner circumference surface of small diameter cylindrical portion 19*b* at a connection portion between small diameter cylindrical portion 19*b* and large diameter main body 19*a*. Furthermore, the entire of sprocket 1 is rotatably supported on an outer circumference surface of this small diameter cylindrical portion 19*b* through support hole 16*a* of rear plate 16.

Seal members 27 are mounted and fixed, respectively, in tip end portions of first to third vanes 20-22. Each of seal members 27 is slid on the inner circumference surface of housing main body 14 to seal.

As shown in FIG. 5, first vane 20 has a relatively large circumferential width. First vane 20 includes a sliding hole 29 which is formed in the inside of first vane 20 in the axial direction, which penetrates through first vane 20, and which constitutes a first lock mechanism 28 described later. Moreover, first vane 20 includes a protruding surface 20*b* which is formed on one circumferential side surface in the counterclockwise direction (on the left side of FIG. 5), which is integrally with first vane 20, and which is arranged to be abutted on first raised surface 11*e* of first shoe 11*a*. Moreover, first vane 20 includes a cutout groove 20*c* which is formed on the inner circumference portion of the front end surface of first vane 20, and which is connected with sliding hole 29. This cutout groove 20*c* is connected to the outside through breath hole 15*c* formed in front plate 15.

Besides, second vane 21 has a small circumferential width.

Third vane 22 has a bottomed sectorial frame shape having a large circumferential width. Third vane 22 includes a sectorial vane receiving space 22*a* which is formed in the inside of third vane 22, and which is connected with rotor receiving space 19*c* of first rotor 19.

A second vane rotor 23 which is a second rotary member is disposed and received within rotor receiving space 19*c* of first rotor 19 and vane receiving space 22*a* of third vane 22.

This second vane rotor 23 includes an annular second rotor 24 which is rotatably received within rotor receiving space 19*c* of first rotor 19; and a fourth vane 25 which is integrally formed on an outer circumference surface of second rotor 24, which protrudes from the outer circumference surface of second rotor 24, and which is pivotally received within vane receiving space 22*a* of third vane 22.

Second rotor 24 has an outside diameter slightly smaller than an inside diameter of rotor receiving space 19*c*. Between an outer circumference surface of second rotor 24 and the inner circumference surface of rotor receiving space 19*c*, there is formed a cylindrical gap 26. Second rotor 24 has an axial length substantially identical to an axial length of rotor receiving space 19*c* of large diameter main body 19*a*.

Moreover, as shown in FIG. 1, second rotor 24 includes an annular mounting groove 24*a* formed at a substantially central portion of a rear end surface of second rotor 24. Tip end portion 6*b* of inner cam shaft 6 is mounted in this mounting groove 24*a* of second rotor 24. Furthermore, second rotor 24 includes an insertion hole 24*b* which is formed at a substantially central portion of second rotor 24, and which penetrates through second rotor 24 in the axial direction. Cam bolt 9 is inserted through this insertion hole 24*b* of second rotor 24 from the axial direction, so that second rotor 24 is tightened and fixed to tip end portion 6*b* of inner cam shaft 6 from the axial direction. Moreover, second rotor 24 is received within rotor receiving space 19*c* of first vane rotor 10 through gap 26 to be relatively rotated.

Moreover, this second rotor 24 includes a connection hole 24*c* formed in a rear end portion of second rotor 24, which penetrates in the radial direction, and which is connected with gap 26.

Fourth vane 25 has a relatively large circumferential width. Fourth vane 25 is received within vane receiving space 22*a* of third vane 22 to be relatively rotated. Between an outer circumference surface 25*c* of fourth vane 25 and an inner circumference surface of vane receiving space 22*a*, there is formed a clearance C (cf. FIG. 9).

A space among the entire outer circumference surface of second vane rotor 23, and the inner circumference surface of first rotor 19, and the inner circumference surface of vane receiving space 22*a*, that is, the entire of vane receiving space 22*a* and the entire of cylindrical gap 26 is constituted as one hydraulic pressure chamber. The hydraulic pressure supplied to this hydraulic pressure chamber is acted, as the same hydraulic pressure, to both circumferential side surfaces 25*a* and 25*b* of fourth vane 25. Accordingly, fourth vane 25 is not relatively rotated by this hydraulic pressure.

Fourth vane 25 includes second sliding hole 42 which penetrates through fourth vane 25 in the axial direction, and within which a second lock pin 43 of second lock mechanism 41 described later is slid. Moreover, fourth vane 25 includes an oil groove 47 which is cut and formed at a front end portion of fourth vane 25, and which is connected with a front end side of second sliding hole 42.

Hydraulic pressure circuit 4 is arranged to supply the hydraulic pressure selectively to retard fluid pressure chambers 12 and advance fluid pressure chambers 13, and to drain (discharge) the hydraulic pressure selectively from retard fluid pressure chambers 12 and advance fluid pressure chambers 13. As shown in FIG. 1, hydraulic pressure circuit 4 includes an advance side passage 36 which is connected to advance side oil grooves 16*d* through annular groove 16*e* formed in rear plate 16; a retard side passage 37 which is connected to retard side oil holes 19*d* formed in first rotor 19; an oil pump 39 arranged to supply the hydraulic pressure selectively to advance side passage 36 and retard side passage 37 through an electromagnetic switching valve (solenoid switching valve) 38; and a drain passage 40 which is connected selectively to advance side passage 36 and retard side passage 37 through a first electromagnetic switching valve 38.

Advance side passage 36 includes a groove between an inner circumference surface of a bearing (not shown) and an outer circumference surface of outer cam shaft 5; an advance side oil hole 36*a* which penetrates this groove in the radial direction, and which is continuously formed by a radial hole and an axial hole of inner cam shaft 6; a radial hole which penetrates through the tip end portion of outer cam shaft 5 in the radial direction; and a connection hole 36*b* which is formed continuously in small diameter portion 19*b* of first rotor 19 in the radial direction, and which connects advance side oil hole 36*a* and annular groove 16*e*.

Retard side passage 37 is connected to retard side oil holes 19*d* through a groove between the inner circumference surface of the bearing (not shown) and the outer circumference surface of outer cam shaft 5, and an oil passage hole (not shown) formed within inner cam shaft 6.

First electromagnetic switching valve 38 is a valve having four ports and two positions (four-port and two-position valve). First electromagnetic switching valve 38 is arranged to control to selectively switch discharge passage 39*a* of oil pump 39 and drain passage 40 to advance side passage 36 and retard side passage 37, by moving a spool valve within first electromagnetic switching valve 38 by an output signal to an electromagnetic coil from a control unit (ECU) (not shown).

An internal computer of the control unit senses a current driving state of the engine by receiving information signals from various sensors such as a crank angle sensor, an air flow meter, a water temperature sensor, and a throttle valve opening degree sensor (not shown). The control unit outputs a control current to the electromagnetic coil of electromagnetic switching valve 38 in accordance with this driving state of the engine.

Figure 8:
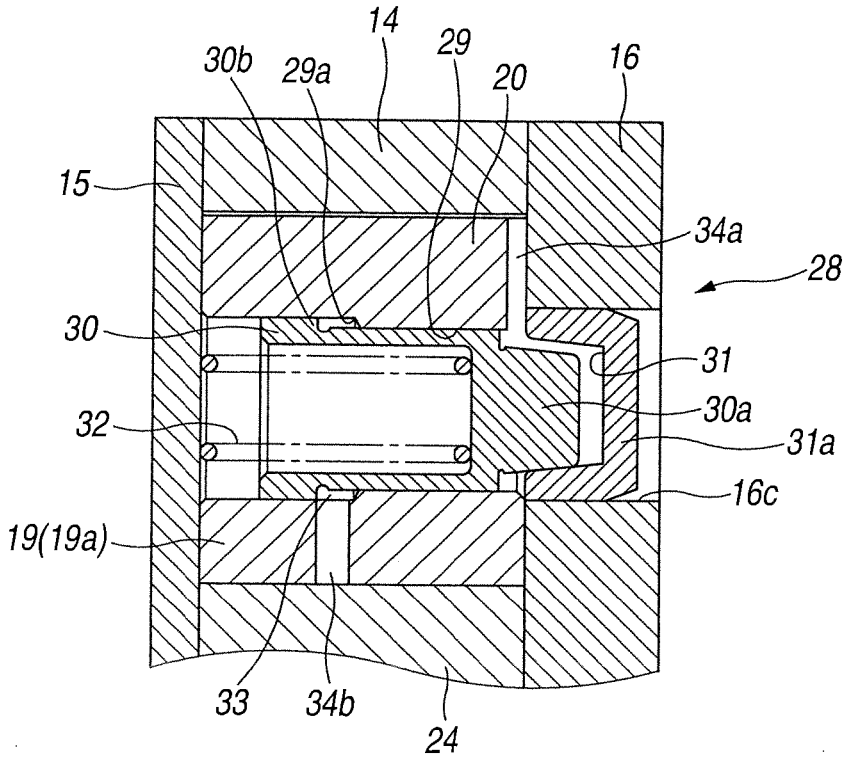
FIG. 8 is a longitudinal sectional view showing a first lock mechanism in the variable valve actuating apparatus according to the first embodiment of the present invention.

As shown in FIG. 1, FIG. 3, and FIG. 8, first lock mechanism 28 includes a first lock pin 30 which is slidably received within sliding hole 29 of first vane 20, and which is arranged to be moved toward and away from (into and out of) the rear plate 16's side; a lock hole 31 which is formed in the cup-shaped hole constituting portion 31*a* that is fixed in holding hole 16*c* of rear plate 16 by the press fit, and with which tip end portion 30*a* of lock pin 30 is arranged to be engaged to lock first vane rotor 10; and an engagement/release mechanism arranged to engage tip end portion 30*a* of lock pin 30 with lock hole 31 in accordance with the driving state of the engine, and to release the engagement between tip end portion 30*a* of lock pin 30 and lock hole 31 in accordance with the driving state of the engine.

Sliding hole 29 has a stepped inner circumference surface including a small diameter hole on the tip end side, and a large diameter hole on the rear end side. Moreover, sliding hole 29 includes an annular stepped portion 29*a* between the small diameter hole and the large diameter hole.

First lock pin 30 has a stepped outer circumference surface corresponding to first sliding hole 29. First lock pin 30 includes a solid tip end portion 30*a* which has a substantially conical shape so as to be easy to be engaged with first lock hole 31. Moreover, first lock pin 30 includes a hollow cylindrical rear end portion including a small diameter portion and a large diameter portion. First lock pin 30 includes a stepped portion 30*b* between the small diameter portion and the large diameter portion. Between stepped portion 29*a* of first sliding hole 29 and stepped portion 30*b* of lock pin 30, there is formed an annular pressure receiving chamber 33.

First lock hole 31 has a bottomed shape. First lock hole 31 is formed at a position at which first lock pin 30 is engaged with first lock hole 31 from the axial direction when first vane rotor 10 is relatively rotated to a most advance angle position. Accordingly, the relative rotational angle between housing 8 and first vane rotor 10 becomes a shift angle phase which is the most advance angle that is optimal for the start of the engine when the first lock pin 30 is engaged with first lock hole 31.

Lock pin 30 constantly ensures the good slidability within sliding hole 29 by connecting breath hole 15*c* of front plate 15 to the outside air.

The engagement/release mechanism includes a first coil spring 32 elastically mounted between the rear end portion of first lock pin 30 and the inner end surface of front plate 15, and arranged to urge first lock pin 30 in a forward direction in which first lock pin 30 is moved into first lock hole 31 of first lock mechanism 28; and a pair of release oil holes 34*a* and 34*b* formed in the both side portions of first vane 20 along a widthwise direction. As shown in FIG. 8, release oil hole 34*a* connected to one of retard fluid pressure chambers 12 is formed in the side surface of first vane 20 on the rear plate 16's side. On the other hand, release oil hole 34*b* connected to one of advance fluid pressure chambers 13 is formed in the inner side surface of first vane 20 on the rear plate 16's side. As shown in FIG. 5, these release oil holes 34*a* and 34*b* are arranged to supply the hydraulic pressure supplied selectively to the one of retard fluid pressure chambers 12 and the one of advance fluid pressure chambers 13, to first lock hole 31 and pressure receiving chamber 33, so as to move first lock pin 30 in a backward direction in which first lock pin 30 is moved out of first lock hole 31.

Figure 9:
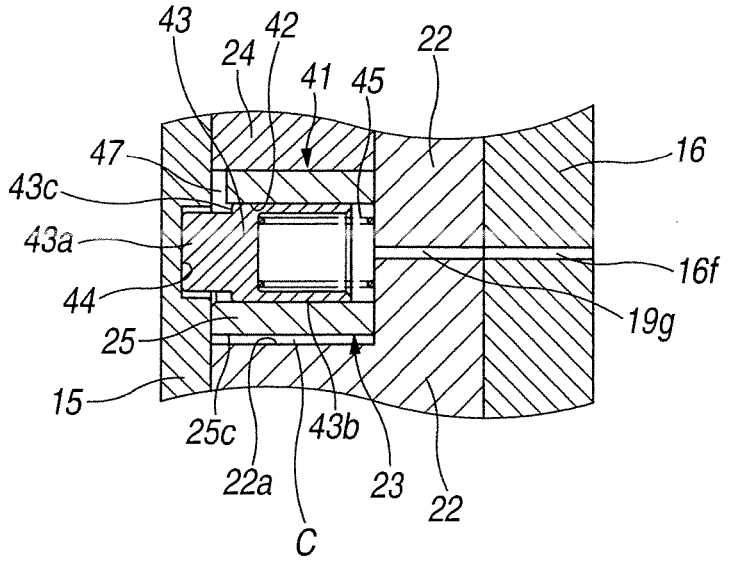
FIG. 9 is a longitudinal sectional view showing a second lock mechanism in the variable valve actuating apparatus according to the first embodiment of the present invention.

As shown in FIGS. 1, 3, and 9, second lock mechanism 41 includes second sliding hole 42 formed in fourth vane 25 of second vane rotor 23 in the axial direction; second lock pin 43 which is slidably received within second sliding hole 42, and which is arranged to be moved toward and away from (into and out of) the front plate 15's side; a second lock hole 44 which is formed in an inner surface of front plate 15, and with which second lock pin 43 is engaged to lock second vane rotor 23; and a second engagement/release mechanism arranged to engage tip end portion 43*a* of second lock pin 43 with second lock hole 44, and to release the engagement between tip end portion 43*a* of second lock pin 43 and second lock hole 44.

Second sliding hole 42 has a cylindrical shape having a substantially uniform inside diameter.

Second lock pin 43 has an outer circumference surface having a stepped shape corresponding to second sliding hole 42. Second lock pin 43 includes a tip end portion 43*a* which is a solid cylindrical shape having a small diameter; and a rear end portion 43*b* having a hollow cylindrical shape having a large diameter. Moreover, second lock pin 43 includes a stepped surface 43*c* between tip end portion 43*a* and rear end portion 43*b*. This stepped surface 43*c* functions as a pressure receiving surface.

As shown in FIG. 1, second lock hole 44 has a circular shape having a bottom. Second lock hole 44 is formed at a position at which second lock pin 43 is engaged with second lock hole 44 from the axial direction when second vane rotor 23 is relatively rotated to the most retard angle position side.

Besides, as shown in FIG. 1, second sliding hole 42 is connected with the outside air through breath hole 16*f* of rear plate 16 and a breath hole 19*g* formed in and penetrated through first rotor 19 in the axial direction. With this, second lock pin 43 constantly ensures the good slidability within second sliding hole 42.

The second engagement/release mechanism includes a second coil spring 45 elastically mounted between the rear end portion of second lock pin 43 and the bottom surface of vane receiving space 22*a*, and arranged to urge second lock pin 43 toward second lock hole 44; and a release hydraulic pressure circuit 46 which is arranged to supply the hydraulic pressure to second lock hole 44, and thereby to move second lock pin 43 in a backward direction in which second lock pin 43 is moved away from (out of) second lock hole 44 so as to release the lock.

As shown in FIG. 1, release hydraulic pressure circuit 46 is constituted independently of hydraulic pressure circuit 4. Release hydraulic pressure circuit 46 includes a release passage 48 which is connected with second lock hole 44 through oil groove 47; and a second electromagnetic switching valve (solenoid valve) 49 which is arranged to connect selectively discharge passage 39*a* of oil pump 39 and drain passage 40 to release passage 48.

Release passage 48 includes a first end portion arranged to be connected through second electromagnetic switching valve 49 to oil pump 39 and drain passage 40; and a second end portion 48*a* connected to connection hole 24*c* through a groove and a radial hole of the outer circumference surface of outer cam shaft 5, and an axial hole formed within inner cam shaft 6 in the axial direction.

Connection hole 24*c* is connected to stepped surface 43*c* of second lock pin 43 and second lock hole 44 through gap 26 between second rotor 24 and rotor receiving space 19*c*, vane receiving space 22*a*, and oil groove 47.

[Function of Present Embodiment]

Firstly, as shown in FIG. 5, at the start of the engine, tip end portion 30*a* of first lock pin 30 is previously engaged with first lock hole 31, and tip end portion 43*a* of second lock pin 43 is also engaged with second lock hole 44.

Figure 11:
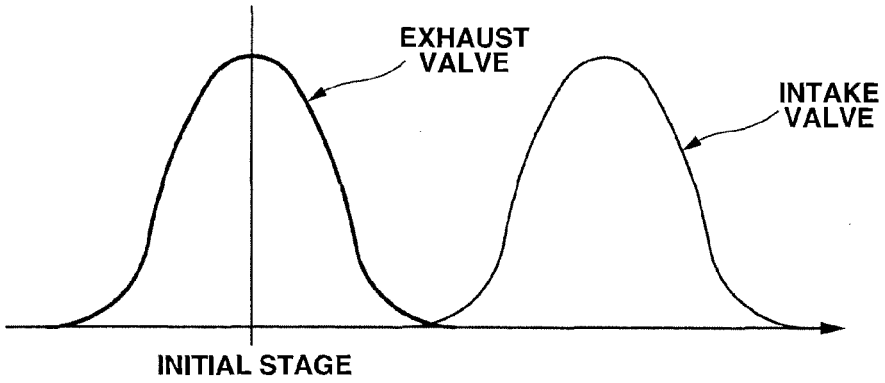
FIG. 11 is a view showing a lift characteristic when two exhaust valves are controlled to the same phase in the variable valve actuating apparatus according to the first embodiment of the present invention.

Accordingly, first vane rotor 10 and second vane rotor 23 are locked at the relative rotational positions on the advance angle side which is optimal for the start of the engine, relative to (with respect to) sprocket 1. With this, as shown in FIG. 2A, two drive cams 5*a* and 6*a* become the same rotational phase through outer cam shaft 5 and inner cam shaft 6. Accordingly, an opening and closing timing characteristic of one of the exhaust valves is held to the phase on the advance angle side at the initial stage, as shown by a bold solid line of FIG. 11.

Consequently, when the engine is started from this state by switching the ignition switch to the ON state, it is possible to obtain the good start performance (startability) by the smooth cranking.

In a predetermined driving region after the start of the engine, the control current is outputted from the control unit of first electromagnetic switching valve 38, so that discharge passage 39*a* and retard side passage 37 are connected with each other, and advance side passage 36 and drain passage 40 are connected with each other. Accordingly, the hydraulic pressure discharged from oil pump 39 is supplied to retard fluid pressure chambers 12 through retard side passage 37. Consequently, retard fluid pressure chambers 12 become the high pressure. On the other hand, the hydraulic pressure within advance fluid pressure chambers 13 is discharged to the oil pan, so that advance fluid pressure chambers 13 become the low pressure.

Moreover, the hydraulic pressure supplied to retard fluid pressure chambers 12 is supplied from release oil hole 34*a* of first vane 20 to pressure receiving chamber 33 of first lock mechanism 28. Accordingly, first lock pin 30 is moved in the backward direction against the spring force of coil spring 32 so that tip end portion 30*a* is moved out of first lock hole 31 so as to allow the free relative rotation of first vane rotor 10.

Accordingly, as shown in FIG. 6, first vane rotor 10 is rotated to the retard angle side relative to housing 8 in accordance with the increase of the pressure of retard fluid pressure chambers 13. With this, first drive cam 5*a* controls the opening/closing timing of one of the exhaust valves to the retard angle side through outer cam shaft 5.

On the other hand, at this time, the control current is not outputted from the control unit to second electromagnetic switching valve 49. Accordingly, release passage 48 and drain passage 40 are connected with each other. Consequently, second vane rotor 23 is held to the lock state by second lock pin 43, so that second vane rotor 23 is held at the position of the advance angle side.

Figure 12:
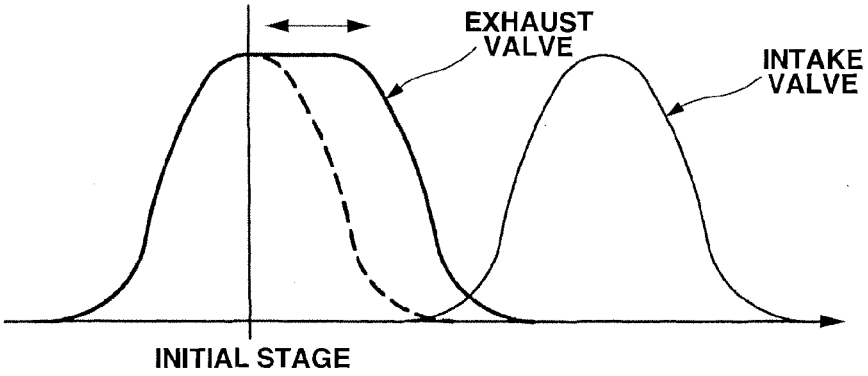
FIG. 12 is a view showing a lift characteristic when one of the exhaust valves is shifted to a retard angle side phase in the variable valve actuating apparatus according to the first embodiment of the present invention.

Therefore, as shown in FIG. 12, second drive cam 6*a* of inner cam shaft 6 holds the opening/closing timing of one of the exhaust valves to the position on the advance angle side, similarly to the start of the engine. On the other hand, as shown in FIG. 2B, first drive cam 5*a* of outer cam shaft 5 is controlled to the rotational position on the retard angle side so that first drive cam 5*a* and second drive cam 6*a* become an open state (open angle state).

Accordingly, as shown in FIG. 12, as to the opening/closing timing characteristic of the one of the exhaust valves, two drive cams 5*a* and 6*a* press the valve lifter during a time period longer than a time period during which two drive cams 5*a* and 6*a* press the valve lifter in the initial phase. That is, the time period during which the one of exhaust valves is opened becomes longer, so that a scavenging time period of the combustion gas is continuously increased.

Figure 4:
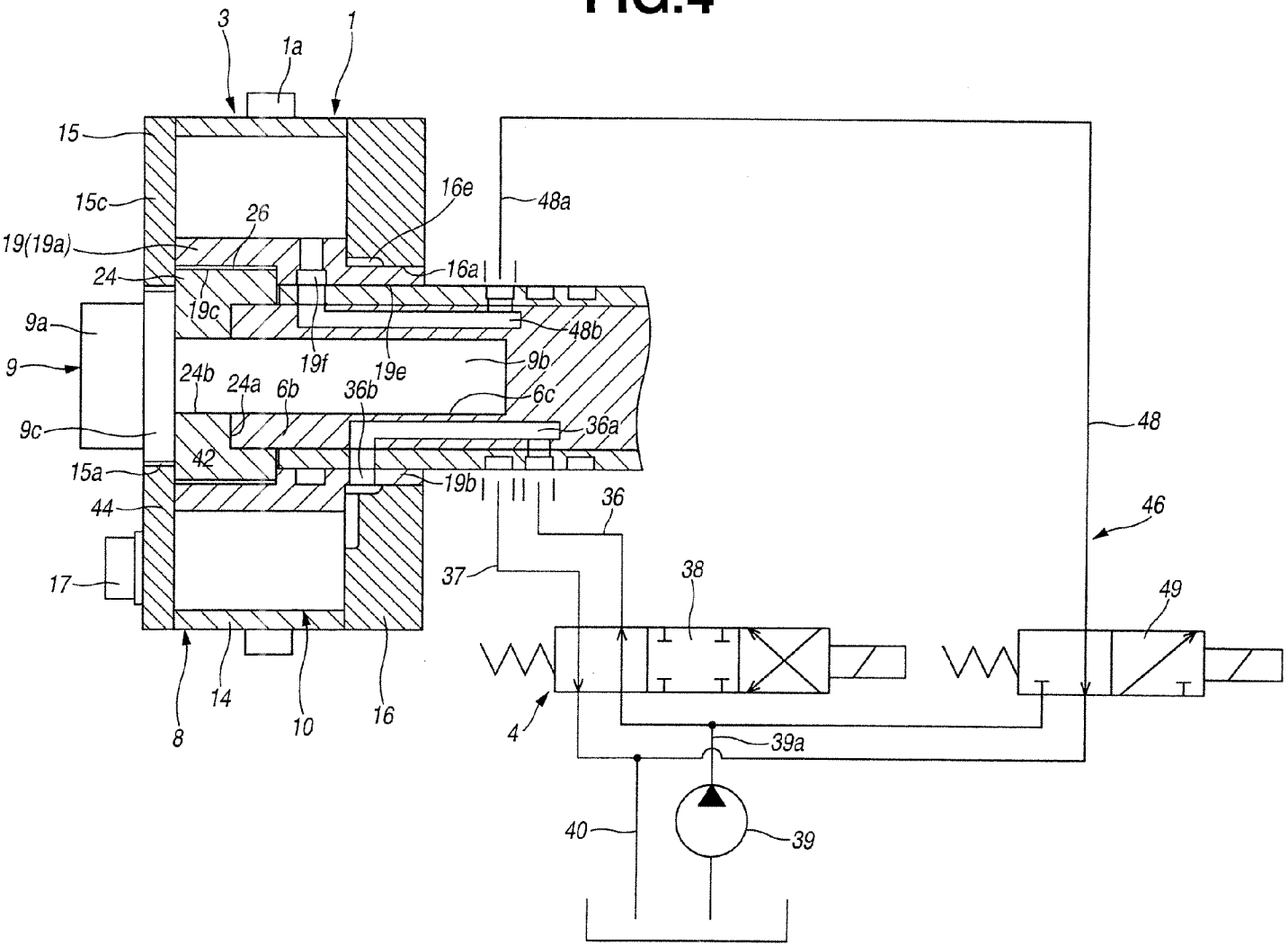
FIG. 4 is a longitudinal sectional view showing an operation of a hydraulic circuit of the variable valve actuating apparatus according to the first embodiment of the present invention.

When the driving state of the engine is further varied, the control current from the control unit to first electromagnetic switching valve 28 is shut off as shown in FIG. 4, so that discharge passage 39*a* and advance side passage 36 are connected with each other, and retard side passage 37 and drain passage 40 are connected with each other. With this, the discharge hydraulic pressure of oil pump 39 is supplied to advance fluid pressure chambers 13, so that the advance fluid pressure chambers 13 become the high pressure. On the other hand, the hydraulic fluid within retard fluid pressure chambers 12 is discharged through drain passage 40 to the oil pan, so that retard fluid pressure chambers 12 become the low pressure state.

At this time, the hydraulic pressure supplied to advance fluid pressure chambers 13 is supplied through release oil hole 34*b* to first lock hole 31, so as to hold the state in which first lock pin 30 is moved in the backward direction (in which first lock pin 30 is moved out of first lock hole 31). Accordingly, first vane rotor 10 is held to a state in which first vane rotor 10 can perform the free relative rotation.

Consequently, first vane rotor 10 is rotated to the advance angle side relative to housing 8. Therefore, first drive cam 5*a* controls, with second drive cam 6*a*, the opening/closing timing of the one of the exhaust valve through outer cam shaft 5 to the advance angle side relative to housing 8, like the case shown in FIG. 11.

Then, when the driving state of the engine is further varied, the control current is supplied from the control unit, respectively, to first electromagnetic switching valve 38 and second electromagnetic switching valve 49. With this, retard side passage 37 and release passage 48 are connected with discharge passage 39*a*. On the other hand, advance side passage 36 and drain passage 40 are connected with each other.

Figure 7:
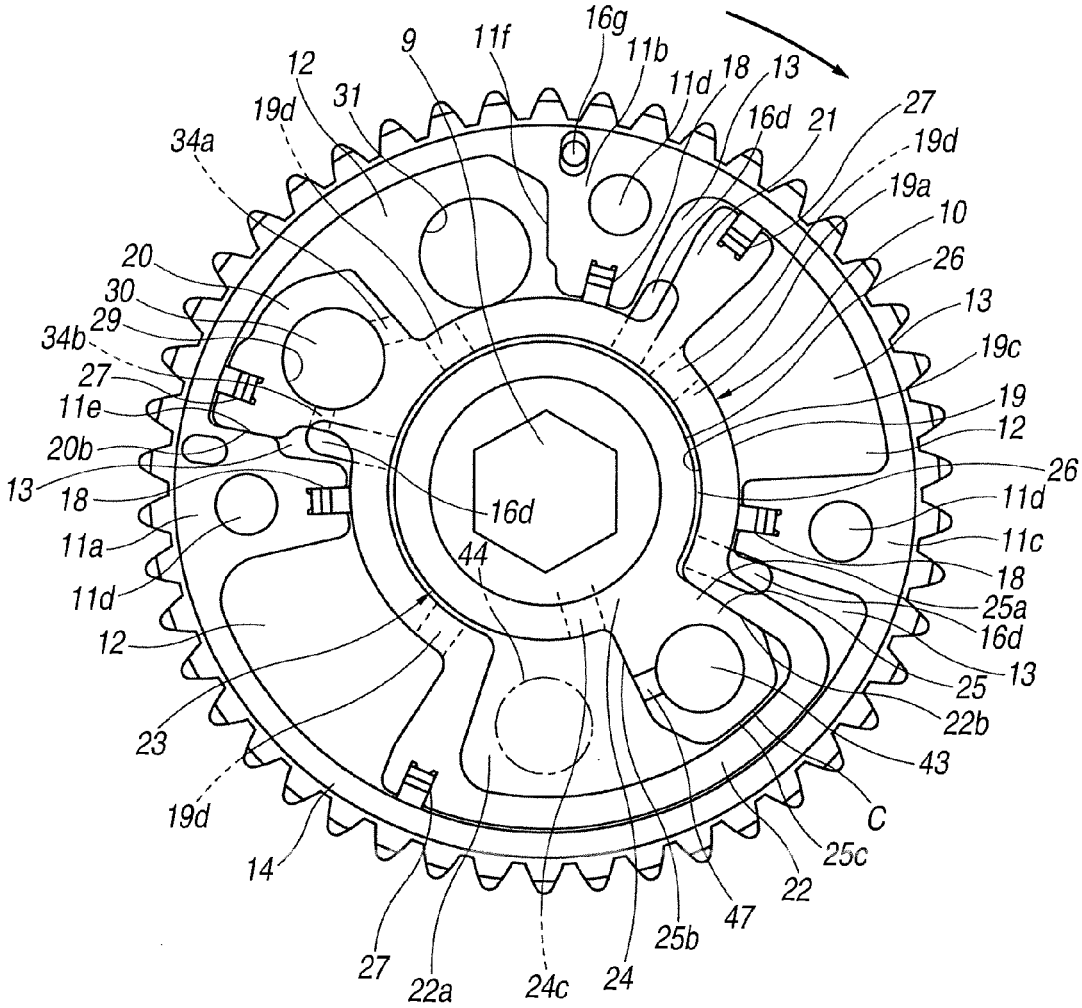
FIG. 7 is a view for illustrating an operation in a state in which a second vane rotor is shifted to a retard angle side when the first vane rotor is on the most retard angle side.

Accordingly, the hydraulic pressure within advance fluid pressure chambers 13 are discharged, so that advance fluid pressure chambers 13 become the low pressure. Moreover, the hydraulic pressure is supplied to retard fluid pressure chambers 12, so that retard fluid pressure chambers 12 become the high pressure. At this time, first lock pin 30 is also held to a state in which the lock is released, by the hydraulic pressure supplied to the one of retard fluid pressure chambers 12. Consequently, as shown in FIG. 7, first vane rotor 10 is rotated in the counterclockwise direction, so that first vane rotor 10 is shifted to the retard angle side relative to housing 8.

On the other hand, the hydraulic pressure discharged from oil pump 39 is supplied from release passage 48 through connection hole 24*c* to rotor receiving space 19*c* and vane receiving space 22*a*. This hydraulic pressure further flows from oil groove 47 to second lock hole 44, so that second lock hole 44 becomes the high pressure. Accordingly, second lock pin 45 is moved in the backward direction against the spring force of second coil spring 45, so that tip end portion 43*a* of second lock pin 45 is moved out of second lock hole 44 so as to release the lock state of second vane rotor 23 to allow the free rotation of second vane rotor 23.

However, second vane rotor 23 cannot be relatively rotated by using the hydraulic pressure. That is, the hydraulic pressure supplied to receiving spaces 19*c* and 22*a* is used only for releasing the lock. This hydraulic pressure supplied to receiving spaces 19*c* and 22*a* cannot give the rotational force (the torque) to second vane rotor 23. Second vane rotor 23 is rotated to the retard angle side by positive alternating torque and negative alternating torque generated in the inner cam shaft 6, in particular, the positive alternating torque.

Figure 10B:
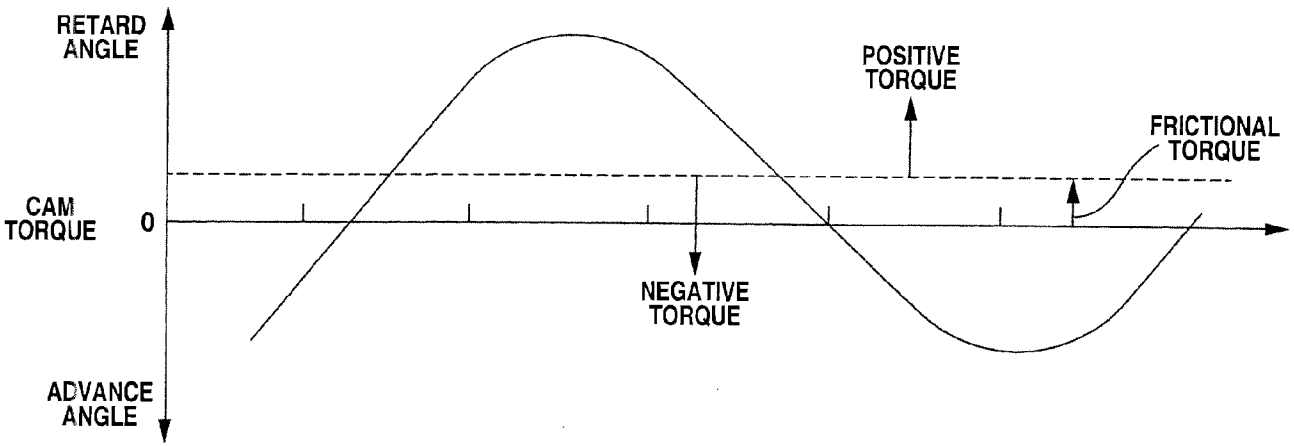

That is, as shown in FIGS. 10A and 10B, the spring force of valve spring 02 which urges the exhaust valve 01 in the closing direction is constantly acted to second drive cam 6*a* of inner cam shaft 6 through valve lifter 03 in a pressing direction in which second drive cam 6*a* of inner cam shaft 6 is pressed (a direction of an arrow in FIG. 10A(a)). When second drive cam 6*a* is rotated to a position at which a rise start surface 3 of a cam mountain 6*c* presses valve lifter 03, second drive cam 6*a* of inner cam shaft 6 receives the positive torque (an arrow) in the opposite direction by the spring force of valve lifter 03 as shown in FIG. 10A(b). As shown in FIG. 10B, this positive torque is acted as the force to rotate inner cam shaft 6 to the retard angle side.

Then, when second drive cam 6*a* is further rotated and second drive cam 6*a* presses valve lifter 03 by an apex portion of cam mountain 6*c* as shown in FIG. 10A(c), the alternating torque becomes substantially 0 at this time as shown in FIG. 10B. Then, when second drive cam 6*a* is further rotated and a declination (falling) start surface of cam mountain 6*c* presses valve lifter 03 as shown in FIG. 10A(d), the negative torque in a direction identical to the rotational direction of second drive cam 6*a* is generated, so as to act to rotate inner cam shaft 6 on the advance angle side (FIG. 10B).

In this way, the positive alternating torque or the negative alternating torque are constantly acted to inner cam shaft 6 during the drive of the engine. However, the positive torque in the direction opposite to the rotational direction is greater than the negative torque in the rotational direction, in consideration of a frictional torque between outer circumference surface 6*b* of second drive cam 6*a* and the upper surface of valve lifter 03.

Accordingly, when first vane rotor 10 is relatively rotated on the retard angle side, second vane rotor 23 is initially positioned within vane receiving space 22*a* at the relative rotational position on the advance angle side, as described above. However, second vane rotor 23 is relatively rotated on the retard angle side by receiving the positive alternating torque, similarly to first vane rotor 10, as shown in FIG. 7. One side surface 25*a* of fourth vane 25 is abutted on a restriction surface 22*b* of third vane 22 which is a circumferential side surface confronting one side surface 25*a* of fourth vane 25, so that fourth vane 25 is held to the relative rotational position on the most retard angle side.

With this, outer cam shaft 5 and inner cam shaft 6 are synchronized with each other, and relatively rotated together on the retard angle side relative to housing 8. In the opening/closing timing of the one of the exhaust valves, the open angle is eliminated. The opening/closing timing of the one of the exhaust valves is entirely shifted to the retard angle side.

Moreover, when the control energization from the control unit to first and second electromagnetic switching valves 38 and 49 are shut off in accordance with the variation of the driving state of the engine, discharge passage 39*a* is connected with advance fluid pressure chambers 13. Moreover, drain passage 40 is connected with retard fluid pressure chambers 12. Furthermore, the connection between release passage 48 and discharge passage 39*a* is shut off, and the release passage 48 is connected to drain passage 40.

Accordingly, outer cam shaft 5 (first vane rotor 10) is shifted in the direction of the initial phase, that is, the relative rotational position on the advance angle side shown in FIG. 5. At this time, inner cam shaft 6 (second vane rotor 23) is pressed in the clockwise direction by restriction surface 22*b* of third vane 22 from the state shown in FIG. 7, that is, the state in which one side surface 25*a* of fourth vane 25 is abutted on restriction surface 22*b* of third vane 22 since first vane rotor is shifted to the advance angle side. Consequently, inner cam shaft 6 (second vane rotor 23) is rotated together with first vane rotor 10 on the advance angle side.

Then, when second vane rotor 23 reaches the rotational position on the most advance angle side shown in FIG. 5, tip end portion 43*a* of second lock pin 43 is engaged with second lock hole 44 by the spring force of second coil spring 45 so as to lock the rotation of second vane rotor 23.

With this, outer cam shaft 5 and inner cam shaft 6 are in synchronism with each other, and shifted to the advance angle side with respect to housing 8.

In this way, in this embodiment, the same hydraulic pressure circuit 4 performs the relative rotation of first vane rotor 10 and the lock release of first lock mechanism 28. Moreover, one release passage 48 performs the lock release of second lock mechanism 41 of second vane rotor 23. Accordingly, it is possible to simplify the structure of the oil passages.

That is, the two passages of retard side passage 37 and advance side passage 36 perform the supply and the drain of the hydraulic pressure to and from retard fluid pressure chambers 12 and advance fluid pressure chambers 13. Moreover, the lock release of first lock pin 30 is performed by using the hydraulic pressures within fluid pressure chambers 12 and 13. Furthermore, the lock release of second lock pin 43 is performed by one release passage 48. Accordingly, the entire apparatus is satisfied by the pressures of the only three systems. Consequently, it is possible to simplify the structure of the hydraulic passages, relative to a conventional apparatus in which a four hydraulic passage systems are used.

That is, in this embodiment, the alternating torque generated in inner cam shaft 6, and the rotational force (torque) of first vane rotor 10 are effectively used for the relative rotation of second vane rotor 23, without using the hydraulic pressure. Accordingly, it is possible to simplify the structure of the hydraulic passages.

Accordingly, it is possible to ease the manufacturing operation and the assembling operation. Moreover, it is possible to decrease the cost, and to decrease the size of the variable valve actuating apparatus.

Moreover, in this embodiment, second vane rotor 23 is received within third vane 22 of first vane rotor 10 (first vane rotor 10). Both vane rotors 10 and 23 are arranged in parallel. Accordingly, it is possible to sufficiently decrease the axial length of the apparatus. Consequently, it is possible to improve the mountability to the engine.

In particular, first rotor 19 is formed into the cylindrical shape, and third vane 22 is formed into the sectorial frame shape. Moreover, second vane rotor 23 is received within these first vane rotor 19 and third vane 22. Accordingly, it is possible to promote the size reduction of the apparatus, and to decrease the size of the whole of the apparatus.

Moreover, lock holes 31 and 44 of first lock mechanism 28 and second lock mechanism 41 are formed in rear plate 16 and front plate 15 which are disposed on the opposite sides. Accordingly, it is possible to ensure the independence of lock holes 31 and 44 of first lock mechanism 28 and second lock mechanism 41, and thereby to improve the control accuracy of the lock and the lock release.

[Second Embodiment]

FIGS. 14-19 show a variable valve actuating apparatus according to a second embodiment of the present invention. In this second embodiment, the variable valve actuating apparatus is applied to the intake valve side.

The hydraulic pressure circuit and the basic structure of the variable valve actuating apparatus according to the second embodiment are substantially identical to those of the first embodiment in most aspects shown by the use of the same reference numerals. Unlike the first embodiment, the directions of first and second vane rotors 10 and 23 in the second embodiment are opposite to those of first and second vane rotors 10 and 23 in the first embodiment.

That is, first vane rotor 10 is received within housing 8 to be relatively rotated. Moreover, fourth vane 23 is received within rotor receiving space 19*c* and vane receiving space 22*a* of first vane rotor 10 to be relatively rotated.

First vane rotor 10 is connected to one end portion of a cylindrical outer cam shaft (not shown) which is a cam shaft on the intake valve side. On the other hand, second vane rotor 23 is connected to one end portion of an inner cam shaft rotatably provided within the outer cam shaft.

Three retard fluid pressure chambers 12 and three advance fluid pressure chambers 13 are separated, respectively, in spaces between housing 8 and first to third vanes 20-22. First lock mechanism 28 is provided within first vane 20. Second lock mechanism 41 is provided within fourth vane 25.

The hydraulic pressure is selectively supplied to and drained (discharged) from retard fluid pressure chambers 12 and advance fluid pressure chambers 13 through the retard side passage and the advance side passage which are arranged to be connected to the drain passage and the discharge passage of the oil pump of the hydraulic pressure circuit. Moreover, the hydraulic pressure is selectively supplied to and drained (discharged) from the pressure receiving chamber 33 and first lock hole 31 of first lock mechanism 28 from release oil holes 34*a* and 34*b* which are connected to the one of the retard fluid pressure chambers 12 and the one of the advance fluid pressure chambers 13.

On the other hand, second lock hole 44 of second lock mechanism 41 is arranged to be connected through the release passage to the discharge passage of the oil pump and the drain passage, like the first embodiment.

As the initial phase, first vane rotor 10 is relatively rotated on the retard angle side which is optimal for the start of the engine, relative to housing 8. Moreover, second vane rotor 23 is similarly rotated on the retard angle side relative to first vane rotor 10.

[Function of Present Embodiment]

Figure 14:
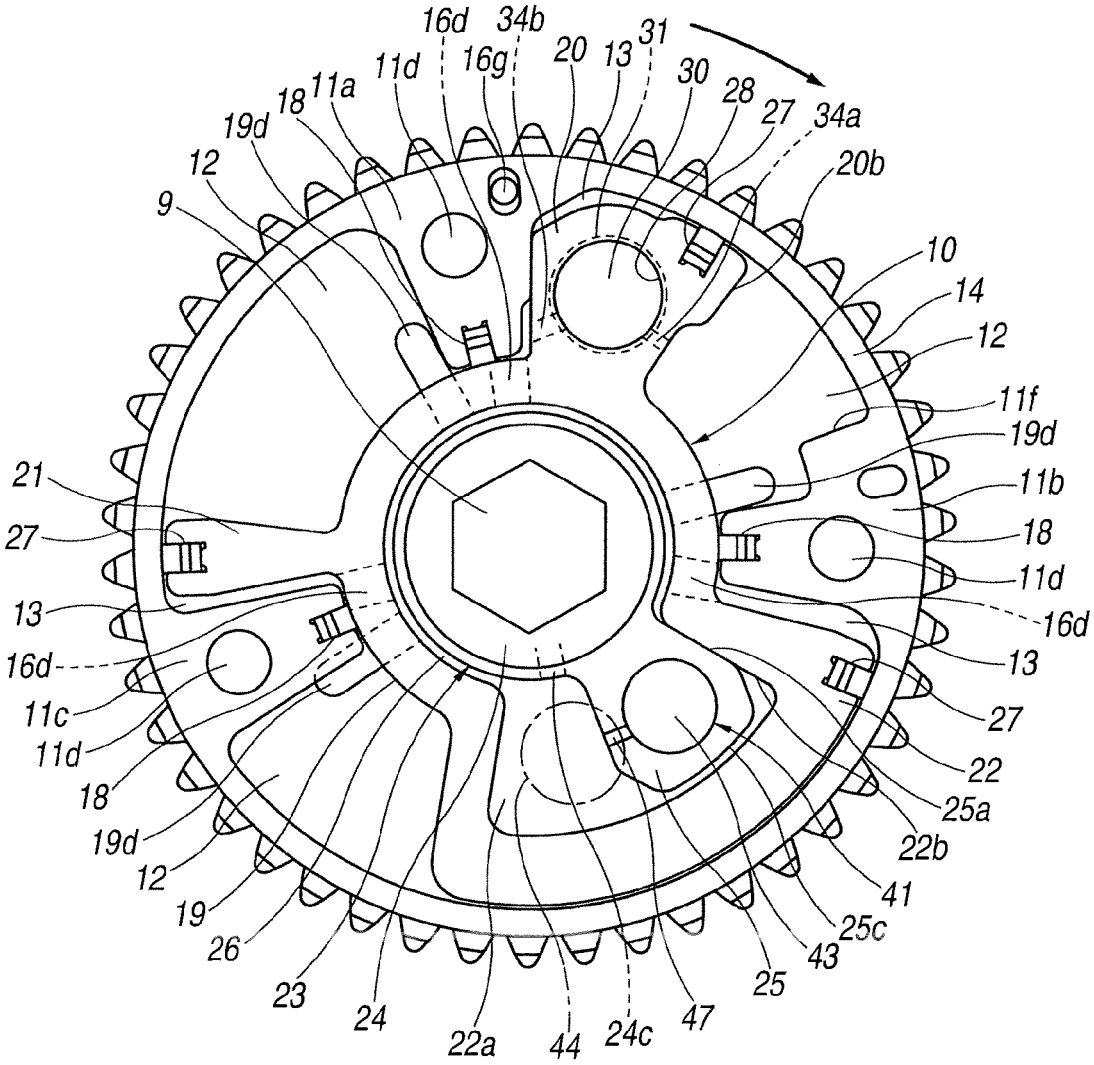
FIG. 14 is a view for illustrating an operation in a state in which a relative rotational phase of a first vane rotor relative to a sprocket is controlled to a most retard angle side, in a variable valve actuating apparatus according to a second embodiment of the present invention is applied to an intake valve side.

First, at the start of the engine, tip end portion 30*a* of first lock pin 30 is previously engaged with first lock hole 31, as shown in FIG. 14. On the other hand, tip end portion 43*a* of second lock pin 43 is moved out of second lock hole 44, so as to be in the lock release state (so that second lock pin 43 is in the lock release state).

That is, first vane rotor 10 is locked at the relative rotational position on the retard angle side which is optimal for the start of the engine, relative to sprocket 1. On the other hand, second vane rotor 20 is not locked by second lock pin 43. When the ignition switch is switched to the ON state, second vane rotor 23 is rotated on the retard angle side, by receiving the alternating torque generated in inner cam shaft 6, in particular, the positive torque. With this, the further rotation of second vane rotor 23 is restricted on the most retard angle side by restriction surface 22*b*.

Accordingly, two drive cams 5*a* and 6*a* become the same rotational phase through outer cam shaft 5 and inner cam shaft 6, as shown in FIG. 2A. The opening/closing timing characteristic of the one of the intake valves is held to the phase on the retard angle side at the initial stage, as shown by a bold solid line in FIG. 17.

With this, it is possible to obtain the good start performance by the smooth cranking.

When the engine is varied to a predetermined driving state after the start of the engine, the control current is outputted from the control unit to both first electromagnetic switching valve 38 and second electromagnetic switching valve 49. With this, discharge passage 39*a* of oil pump 39 is connected to advance side passage 36, and drain passage 37 is connected to retard side passage 37. On the other hand, discharge passage 39*a* and release passage 48 are connected with each other.

Figure 15:
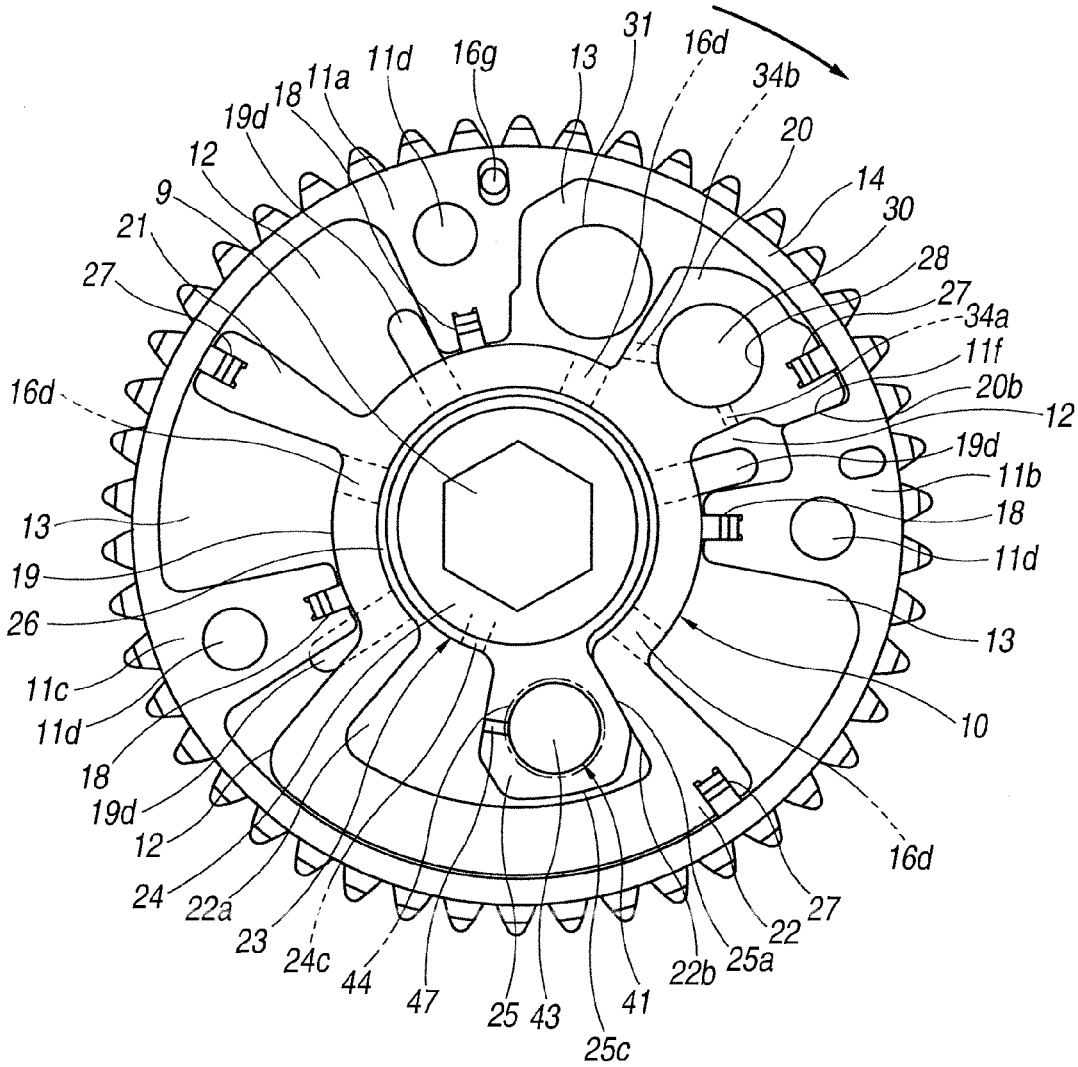
FIG. 15 is a view for illustrating an operation in a state in which a relative rotational phase of the first vane rotor relative to the sprocket is controlled to the most advance angle side in the variable valve actuating apparatus according to the second embodiment.

Accordingly, advance fluid pressure chambers 13 become the high pressure, and retard fluid pressure chambers 12 become the low pressure. Consequently, the hydraulic pressure within the one of advance fluid pressure chambers 13 is supplied to first lock hole 31, so that the lock by first lock pin 30 is released so as to allow the relative rotation of first vane rotor 10. Therefore, first vane rotor 10 is rotated in the clockwise direction as shown in FIG. 15, and rotated on the advance angle side relative to housing 8.

At this time, in second vane rotor 23, one side surface 25*a* of fourth vane 25 is pressed in the clockwise direction by restriction surface 22*b* of third vane 22 in accordance with the rotation of first vane rotor 10 in the clockwise direction. With this, second vane rotor 23 is relatively rotated on the advance angle side together with first vane rotor 10. At this advance angle position, the hydraulic pressure is supplied to second lock hole 44. Accordingly, second lock pin 43 is not engaged with second lock hole 44 by the spring force of second coil spring 45, and second vane rotor 23 is held at the relative rotational position on the advance angle side.

Figure 18:
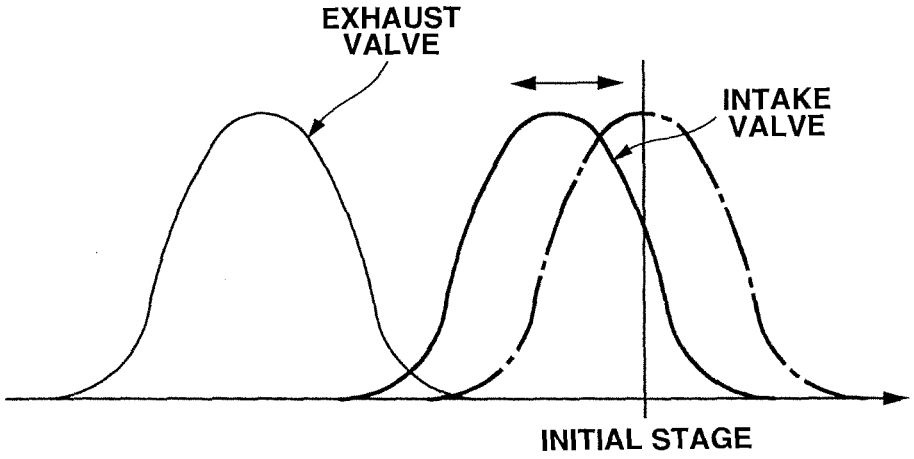
FIG. 18 is a view showing a lift characteristic that both of the two intake valves are shifted together to the phase on the advance angle side in the variable valve actuating apparatus according to the second embodiment of the present invention.

Accordingly, outer cam shaft 5 and inner cam shaft 6 are relatively rotated together on the advance angle side. Consequently, both drive cams 5*a* and 6*a* become the same phase shown in FIG. 2A. The opening/closing timing characteristic of the one of the intake valves is shifted to the phase on the advance angle side, as shown in FIG. 18.

When the driving state of the engine is further varied, the energization of first electromagnetic switching valve 38 from the control unit is shut off. Discharge passage 39*a* and retard side passage 37 are connected with each other. Drain passage 40 and advance side passage 36 are connected with each other. At the same time, the energization to second electromagnetic switching valve 49 is shut off.

Figure 16:
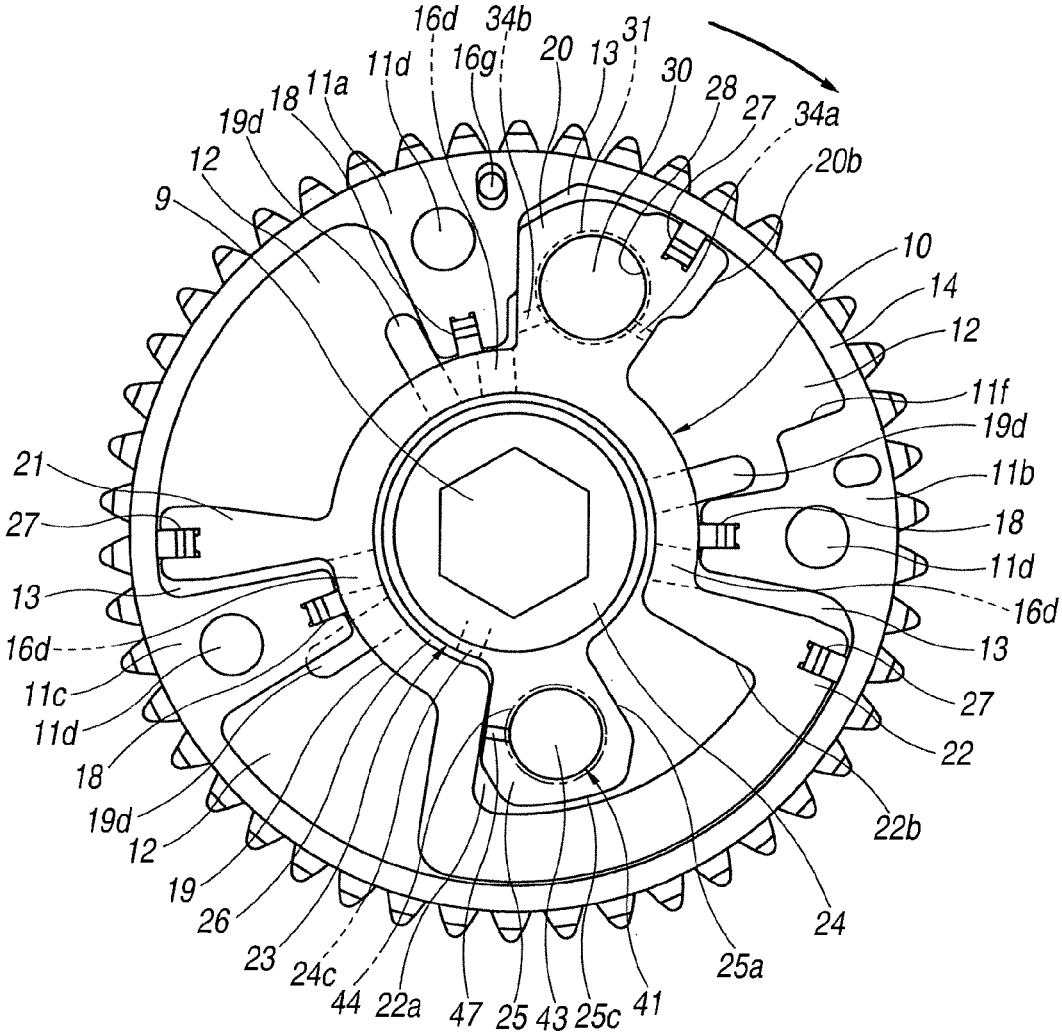
FIG. 16 is a view for illustrating an operation in a state in which the second vane rotor is shifted to the advance angle side in the most retard angle side of the first vane rotor.
Figure 17:
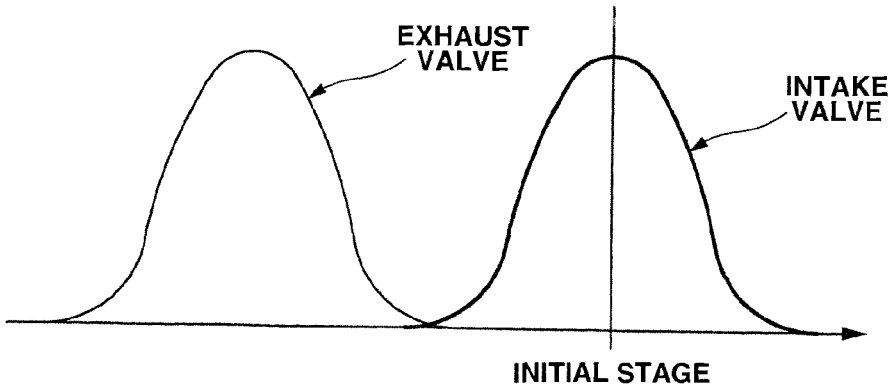
FIG. 17 is a view showing a lift characteristic that the two intake valves are controlled to the same phase in the variable valve actuating apparatus according to the second embodiment of the present invention.

Accordingly, retard fluid pressure chambers 12 become the high pressure, and advance fluid pressure chambers 13 become the low pressure. Consequently, when first vane 20 is rotated in the counterclockwise direction and abutted on the one side surface of first shoe 11*a* as shown in FIG. 16, the further rotation of first vane rotor 10 is restricted. Therefore, first vane rotor 10 is held at the relative rotational position on the most retard angle side relative to housing 8. At this time, the hydraulic pressure of the one of retard fluid pressure chambers 12 is supplied to pressure receiving chamber 33. Accordingly, first lock pin 30 is moved out of first lock hole 31, so as to become the lock release state.

On the other hand, the discharge hydraulic pressure is not supplied to second lock hole 44, so that second lock pin 43 becomes the lock state. Accordingly, second vane rotor 23 is positioned at the relative rotational position on the advance angle side.

Accordingly, the only outer cam shaft 5 is relatively rotated on the retard angle side. Inner cam shaft 6 is held at the relative rotational position on the advance angle side. Consequently, first drive cam 5*a* and second drive cam 5*b* become the open angle state, as shown in FIG. 2B.

Figure 19:
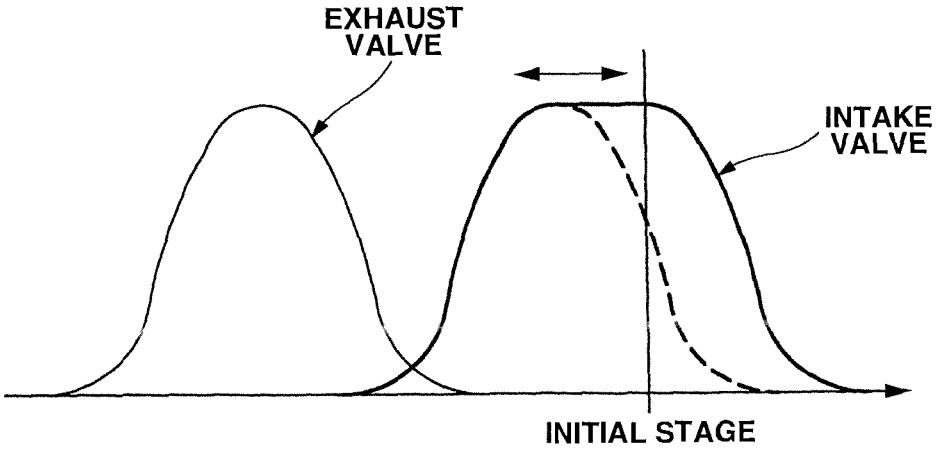
FIG. 19 is a view showing a lift characteristic that one of the intake valves is shifted to the phase on the retard angle side in the variable valve actuating apparatus according to the second embodiment of the present invention.

Accordingly, as to the opening/closing timing characteristic of the one of the intake valves, two drive cams 5*a* and 6*a* press the valve lifter during a time period longer than a time period during which two drive cams 5*a* and 6*a* press the valve lifter in the initial phase, as shown in FIG. 19. That is, the time period during which the one of the intake valves is opened becomes longer. The filling time period of the intake air amount is continuously increased. Accordingly, it is possible to ensure the sufficient amount of the air. Consequently, it is possible to sufficiently increase the output torque of the engine.

Then, in this state, the shut-off of the energization from the control unit to first electromagnetic switching valve 38 is maintained, and second electromagnetic switching valve 49 is energized. With this, the hydraulic pressure is supplied to retard fluid pressure chambers 12. Retard fluid pressure chambers 12 become the high pressure. Advance fluid pressure chambers 13 become the low pressure. On the other hand, the hydraulic pressure is supplied through release side passage 48 to second lock hole 44, so that second lock hole 44 becomes the high pressure.

With this, first vane rotor 10 is held at the relative rotational position on the most retard angle side. Moreover, second lock pin 43 is moved in the backward direction, and moved out of second lock hole 44. Consequently, the lock of second vane 23 is released.

In this state, when the ignition switch is switched to the OFF state, the energization from the control unit to second electromagnetic switching valve 49 is shut off, and the drive of oil pump 39 is stopped.

Accordingly, first vane rotor 10 is held at the relative rotational position on the most retard angle. On the other hand, second vane rotor 23 is relatively rotated on the retard angle side by the positive alternating torque generated in inner cam shaft 6, similarly to first vane rotor 10, as described above. Consequently, first and second vane rotors 10 and 23 are held at the position on the retard angle at the initial stage, as shown in FIG. 14.

As described above, in the second embodiment, it is possible to simplify the structure of the hydraulic passages. Moreover, second vane rotor 23 is arranged within second vane rotor 21 of first vane rotor 10 in a parallel state. With this, it is possible to decrease the axial length of the apparatus. Therefore, it is possible to decrease the size of the apparatus, and to improve the mountability to the engine.

[Third Embodiment]

FIGS. 20-25 show a variable valve actuating apparatus according to a third embodiment of the present invention. The basic structure of the variable valve actuating apparatus according to the third embodiment is substantially identical to those of the second embodiment in most aspects shown by the use of the same reference numerals. Unlike the second embodiment, there is provided a third lock mechanism 50 arranged to lock (connect) first vane rotor 10 and second vane rotor 23, and to release the lock between first vane rotor 10 and second vane rotor 23.

Figure 23:
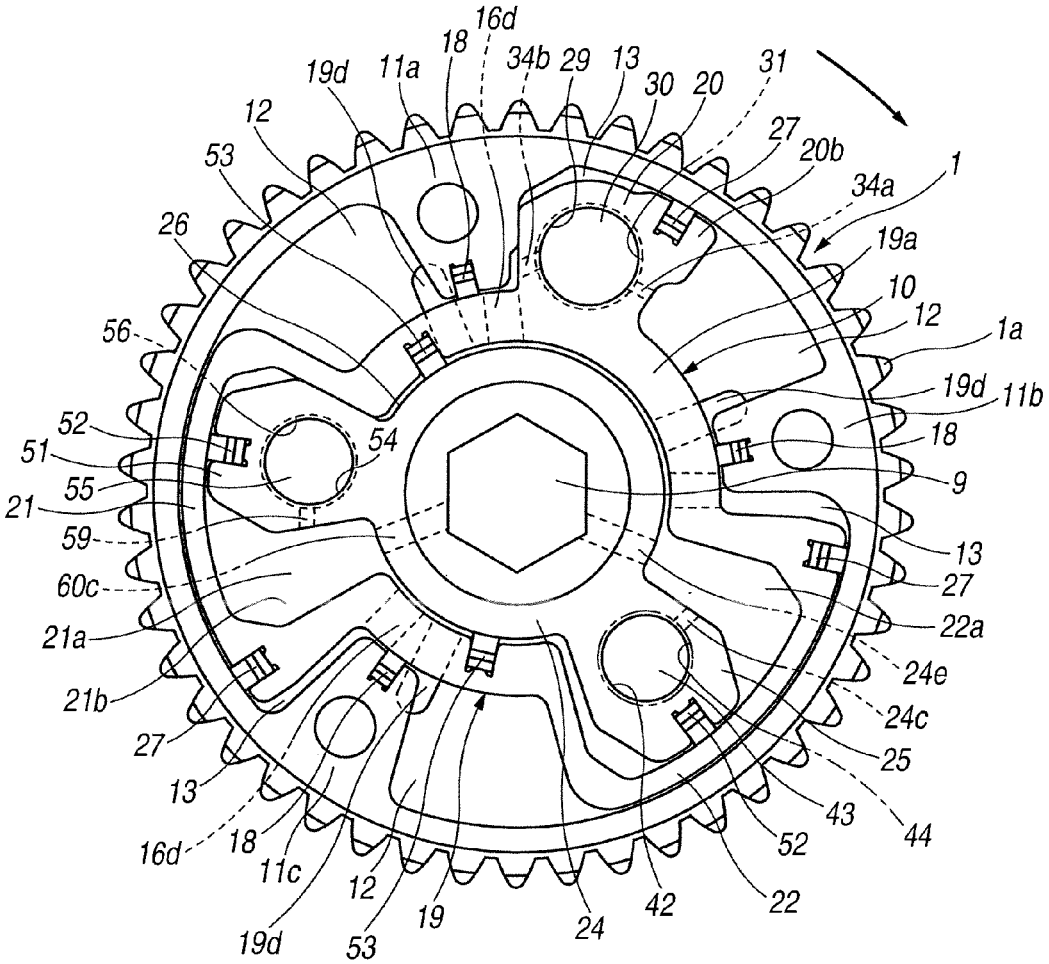
FIG. 23 is an a view for illustrating an operation in a state in which relative rotational phases of the first vane rotor and the second vane rotor relative to the sprocket are controlled to the phase on the most retard angle side, in the variable valve actuating apparatus according to the third embodiment.

That is, first vane rotor 10 is provided within housing 8 to be relatively rotated. As shown in FIG. 23, in this first vane rotor 10, second vane 21 is formed into a sectorial frame shape including a bottom wall 21*b*, similarly to third vane 22. Second vane 21 includes a sectorial second vane receiving space 21*a* formed within second vane 21. On the other hand, second vane rotor 23 includes a fifth vane 51 which is provided integrally with second vane rotor 23 (second rotor 24), and which is located at a position different from the position of fourth vane 25 on the outer circumference of second rotor 24, that is, at a position corresponding to second vane receiving space 21*a*. To This fifth vane 51 is received within second vane receiving space 21*a* to be rotated relative to first vane rotor 10.

Moreover, two seal members 52 and 52 are mounted and fixed in mounting grooves formed, respectively, on outer circumference surfaces of fourth vane 25 and fifth vane 51. Seal members 52 and 52 are abutted, respectively, on the inner circumference surfaces of the corresponding second vane 21 and the corresponding third vane 22. On the other hand, two seal members 53 and 53 are mounted and fixed in mounting grooves formed on the inner circumference surface of first rotor 19 at predetermined positions. Seal members 53 and 53 are slidably abutted, respectively, on the outer circumference surface of second rotor 24. These seal members 52 and 53 shut off the connection between vane receiving spaces 21*a* and 22*a*, and the connection between vane receiving spaces 21*a* and 22*a* and rotor receiving space 19*c*.

Between fifth vane 51 and first vane rotor 10, there is provided a third lock mechanism 50 arranged to lock between first vane rotor 10 and second vane rotor 23, and to release the lock between first vane rotor 10 and second vane rotor 23.

Figure 21:
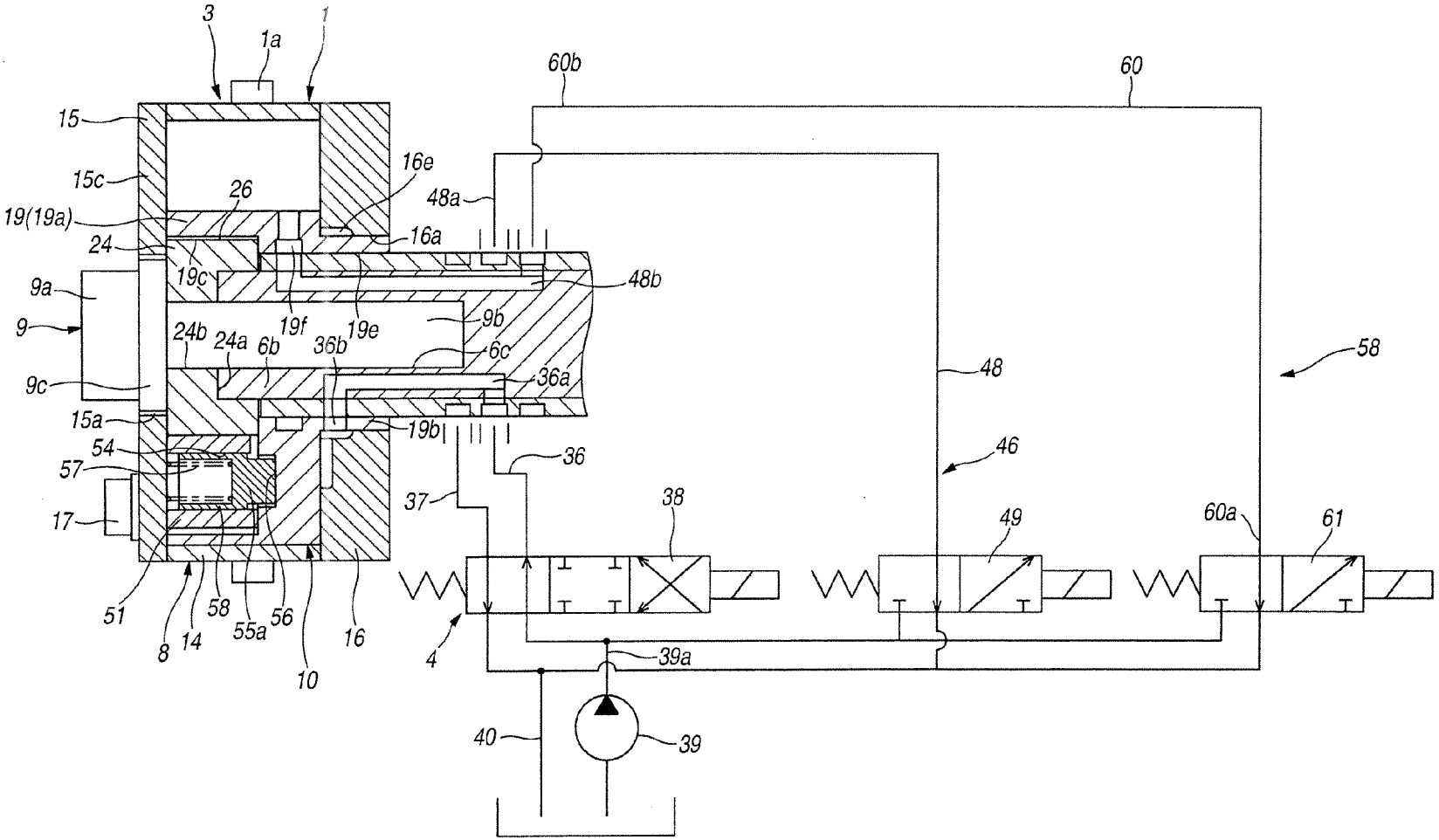
FIG. 21 is an overall schematic view showing a third lock mechanism in the variable valve actuating apparatus according to the third embodiment.
Figure 22:
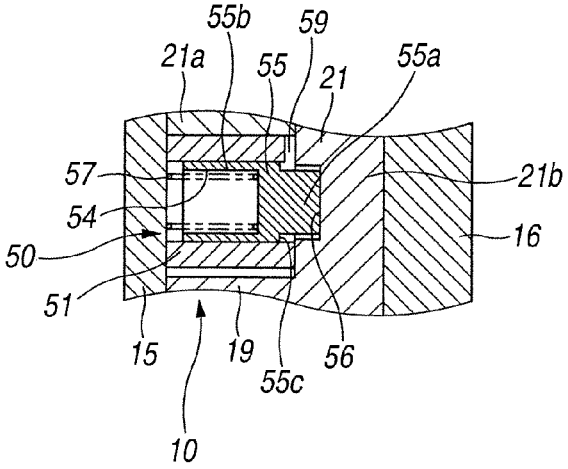
FIG. 22 is an enlarged sectional view showing a main part of the third lock mechanism in the variable valve actuating apparatus according to the third embodiment.

As shown in FIGS. 21 and 22, this third lock mechanism 50 includes a third sliding hole 54 formed in fifth vane 51 in the axial direction; a third lock pin 55 slidably received within third sliding hole 54, and arranged to be moved toward and away from (into and out of) bottom wall 21*b* of second vane 21; a third lock hole 56 which is formed on a bottom surface of bottom wall 21*b* of second vane 21, and with which third lock pin 55 is arranged to be engaged to lock second vane rotor 23 with respect to first vane rotor 10; and a third engagement/release mechanism arranged to engage a tip end portion 55*a* of third lock pin 55 with third lock hole 56, and to release the engagement between tip end portion 55*a* of third lock pin 55 and third lock hole 56.

Third sliding hole 54 has a cylindrical shape having a substantially uniform inside diameter.

Third lock pin 55 includes an outer circumference surface having a steppes shape corresponding to third sliding hole 54. Third lock pin 55 includes tip end portion 55*a* which is a solid cylindrical shape having a small diameter; a rear end portion 55*b* which is a hollow cylindrical shape having a large diameter; and a stepped surface 55*c* between tip end portion 55*a* and rear end portion 55*b*. This stepped surface 55*c* of third lock pin 55 functions as a pressure receiving surface.

Third lock hole 56 is formed into a circular shape having a bottom. Third lock hole 56 is formed at a position at which third lock pin 55 is engaged with third lock hole 56 from the axial direction when second vane rotor 23 is rotated on the most advance angle side relative to first vane rotor 10.

Third sliding hole 54 is connected through a breath hole (not shown) to the outside air. With this, it is possible to constantly ensure the good slidability of third lock pin 55 within third sliding hole 54.

The third engagement/release mechanism includes a third coil spring 57 elastically mounted between the rear end portion of lock pin 55 and the inner side surface of front plate 15, and arranged to urge third lock pin 55 in a direction toward third lock hole 56; and a release hydraulic pressure circuit 58 arranged to supply the hydraulic pressure to third lock hole 56 (pressure receiving surface 55*c*), and thereby to move third lock pin 55 out of third lock hole 56 to release the lock.

Figure 20:
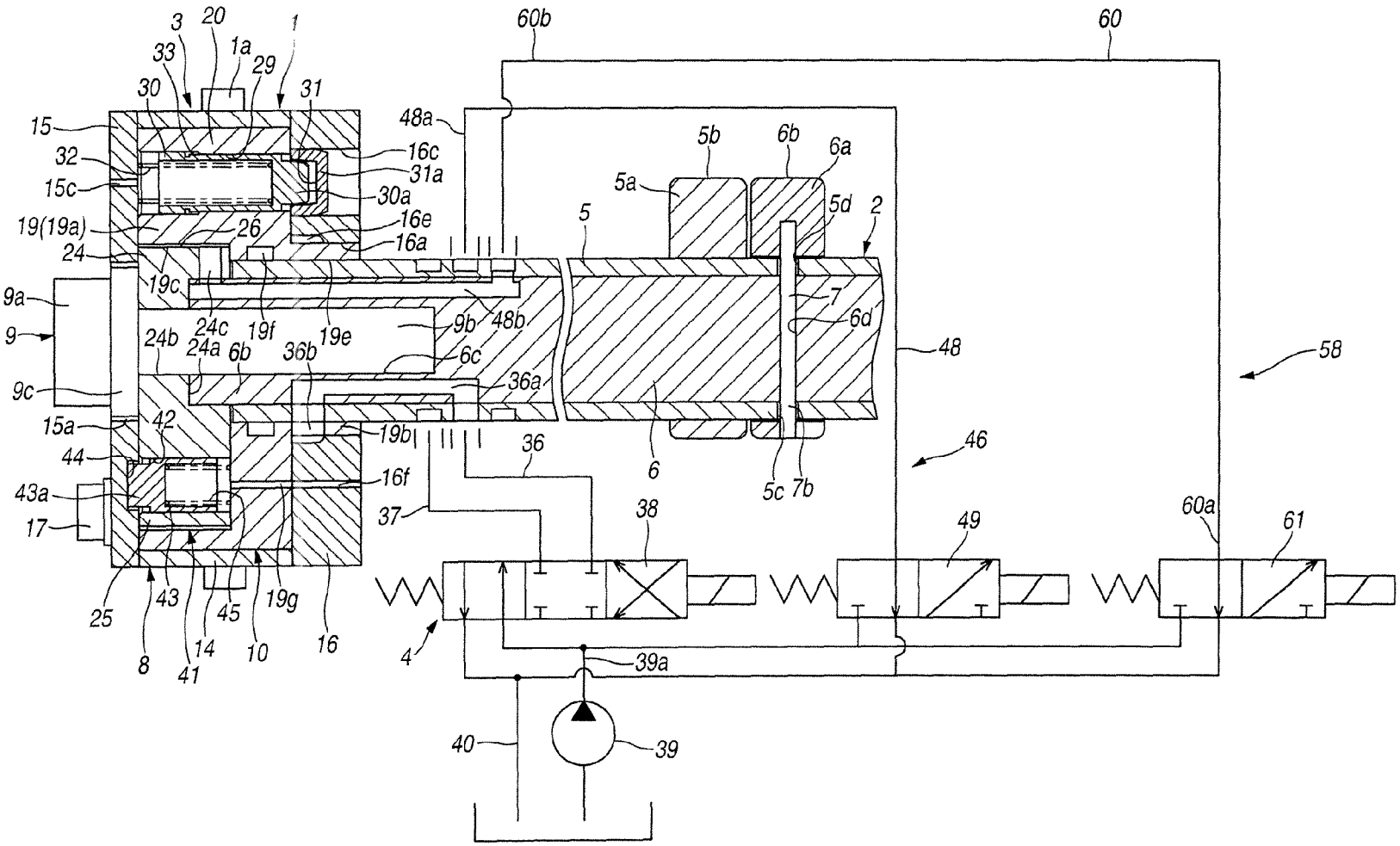
FIG. 20 is an overall schematic view showing a variable valve actuating apparatus according to a third embodiment of the present invention.

As shown in FIGS. 20 and 21, release hydraulic pressure circuit 58 is constituted independently of hydraulic pressure circuit 4 and release hydraulic pressure circuit 46 of second lock mechanism 41. Release hydraulic pressure circuit 58 includes a release passage 60 connected to third lock hole 56 through second vane receiving space 21*a* and a third oil hole 59 formed in one circumferential side wall of fifth vane 51; and a third electromagnetic switching valve (solenoid valve) 61 arranged to connect selectively discharge passage 39*a* of oil pump 39 and drain passage 40 to release passage 60.

Release passage 60 includes a first end portion 60*a* arranged to be connected through electromagnetic switching valve 61 to oil pump 39 and drain passage 40, and a second end portion 60*b* connected to vane receiving space 21*a* on the third oil hole 59's side through a groove and a radial hole of the outer circumference surface of outer cam shaft 5, an axial hole (not shown) formed within inner cam shaft 6 in the axial direction, and a radial hole 60*c* (cf. FIG. 23) formed in the inner cam shaft 6 in the radial direction. Third oil hole 59 is connected to third lock hole 56 through stepped surface 55*c* of third lock pin 55.

As the initial phase, first vane rotor 10 is rotated on the retard angle side which is optimal for the start of the engine, relative to housing 8. As the initial phase, second vane rotor 23 is rotated on the advance angle side relative to first vane rotor 10.

[Function of Present Embodiment]

First, at the start of the engine, tip end portion 30*a* of first lock pin 30 is previously engaged with first lock hole 31, as shown in FIG. 23. Moreover, tip end portion 43*a* of second lock pin 43 and tip end portion 55*a* of third lock pin 55 are engaged, respectively, with second lock hole 44 and third lock hole 56.

That is, first vane rotor 10 is locked at the relative rotational position which is optimal for the start of the engine, relative to sprocket 1. On the other hand, second vane rotor 23 is locked by second lock pin 43. First vane rotor 10 and second vane rotor 23 are locked by third lock pin 55.

Accordingly, two drive cams 5*a* and 6*a* become the same rotational phase through outer cam shaft 5 and inner cam shaft 6. The opening/closing timing characteristic of the one of the exhaust valves is held to the phase on the retard angle side in the initial stage, as shown by the bold line of FIG. 17, like the second embodiment.

Accordingly, it is possible to obtain the good start performance by the smooth cranking when the ignition switch is switched to the ON state in the above-described state.

When the driving state is varied to a predetermined driving state after the start of the engine, the control current is outputted from the control unit to both first electromagnetic switching valve 38 and second electromagnetic switching valve 49. With this, discharge passage 39*a* of oil pump 39 is connected to advance side passage 36. Drain passage 40 is connected to retard side passage 37. On the other hand, discharge passage 39*a* and release passage 48 are connected with each other.

Moreover, at this time, the control current is not outputted to third electromagnetic switching valve 61. Accordingly, release hydraulic pressure circuit 58 is connected to drain passage 40. Consequently, third lock pin 55 is held to be engaged with third lock hole 56. Therefore, first vane rotor 10 and second vane rotor 23 are in the lock state.

Accordingly, the advance fluid pressure chambers 13 become the high pressure, and retard fluid pressure chambers 12 become the low pressure. The hydraulic pressure within the one of advance fluid pressure chambers 13 is supplied to first lock hole 31. With this, the lock by first lock pin 30 is released to allow the relative rotation of first vane rotor 10. Therefore, as shown in FIG. 24, first vane rotor 10 is rotated in the clockwise direction, and rotated on the advance angle side relative to housing 8.

On the other hand, the pump discharge pressure supplied through release passage 48 to vane receiving space 22*a* is supplied to second lock hole 44 through oil groove 47. Second lock pin 43 is moved in the backward direction by the hydraulic pressure acted to pressure receiving surface (stepped surface) 43*c*. With this, second lock pin 43 is moved out of second lock hole 44, so that the lock of second vane rotor 23 is released.

Figure 24:
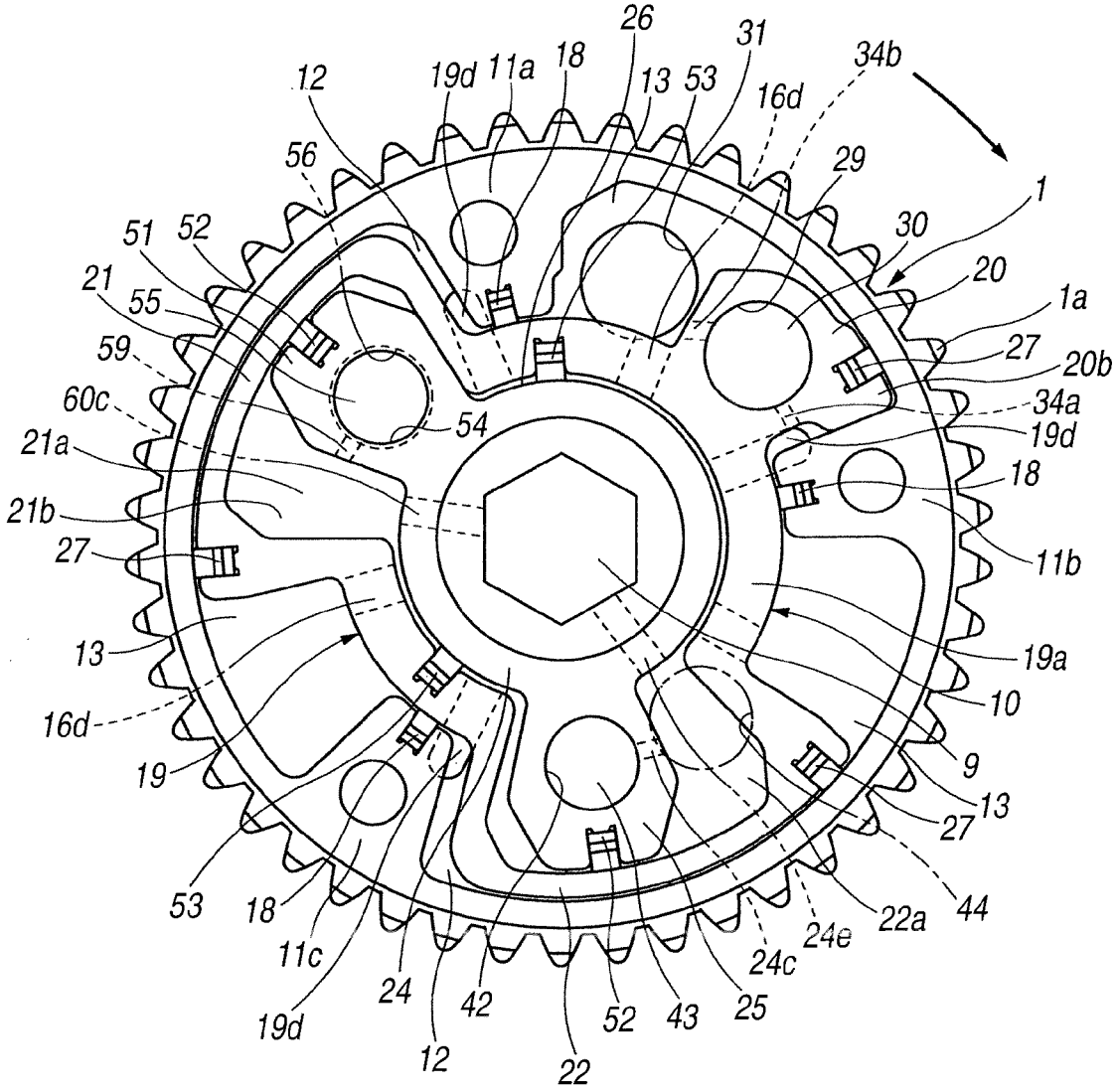
FIG. 24 is a view for illustrating an operation in which the relative rotational phases of the first vane rotor and the second vane rotor relative to the sprocket are controlled to the phase on the most advance angle side, the variable valve actuating apparatus according to the third embodiment.

Accordingly, this second vane rotor 23 is similarly rotated in the clockwise direction in synchronous with the rotation of first vane rotor in the clockwise direction, as shown in FIG. 24. Second vane rotor 23 is relatively rotated on the advance angle side together with first vane rotor 10. At this advance position, the hydraulic pressure is supplied to second lock hole 44. Accordingly, second lock pin 43 is not engaged with second lock hole 44 by the spring force of second coil spring 45, and second vane rotor 23 is held at the relative rotational position on the advance angle side.

Accordingly, outer cam shaft 5 and inner cam shaft 6 are rotated on the advance angle side, so that both drive cams 5*a* and 6*a* become the same rotational phase. The opening/closing timing characteristic of one of the intake valves is shifted to the phase on the advance angle side, as shown in FIG. 18, like the second embodiment.

When the driving state of the engine is further varied, the energization to first electromagnetic switching valve 38 from the control unit is shut off. Accordingly, discharge passage 39*a* and retard side passage 37 are connected with each other, and drain passage 40 and advance side passage 36 are connected with each other. Concurrently, the energization to second electromagnetic switching valve 49 is shut off.

Accordingly, retard fluid pressure chambers 12 become the high pressure. On the other hand, advance fluid pressure chambers 13 become the low pressure. Accordingly, when first vane 10 is rotated in the counterclockwise direction and abutted on the one circumferential side surface of first shoe 11*a* as shown in FIG. 23, the further rotation of first vane rotor 10 is restricted. First vane rotor 10 is held at the relative rotational position on the most retard angle side relative to housing 8. At this time, the hydraulic pressure of the one of the retard fluid pressure chambers 12 is supplied to pressure receiving chamber 33. Accordingly, first lock pin 30 is moved out of first lock hole 31, so as to be in the lock release state.

On the other hand, second vane rotor 23 is integrally connected with first vane rotor 10 by third lock mechanism 50. Accordingly, second vane rotor 23 is rotated together with first vane rotor 10 in the counterclockwise direction, and similarly shifted to the relative rotational position on the most retard angle side. At this time, the discharge hydraulic pressure is not supplied to second lock hole 44. Accordingly, second lock pin 43 is engaged with second lock hole 44 by the spring force of second coil spring 45, and second vane rotor 23 becomes the lock state.

With this, first and second vane rotors 10 and 23 are shifted to the relative rotational position on the most retard angle side, similarly to the start of the engine. The opening/closing timing characteristic of the one of the intake valves is controlled to the most retard angle side, similarly to the start of the engine.

When the driving state of the engine is further varied from the relative rotational position of first and second vane rotors 10 and 23 shown in FIG. 23, the control unit energizes first electromagnetic switching valve 38 and third electromagnetic switching valve 61. With this, discharge passage 39*a* is connected with advance side passage 36 and release passage 58. Accordingly, advance fluid pressure chambers 13 become the high pressure, and moreover third lock hole 56 becomes the high pressure. On the other hand, second electromagnetic switching valve 49 is not energized from the control unit, so that the hydraulic pressure is not supplied to second lock hole 44.

Accordingly, the hydraulic pressure within the one of advance fluid pressure chambers 13 is supplied to first lock hole 31, so that first lock pin 30 is moved in the backward direction in which the first lock pin 30 is moved out of first lock hole 31. With this, the lock of first vane rotor 10 to housing 8 is released. Moreover, third lock pin 55 is moved in the backward direction in which third lock pin 55 is moved out of third lock hole 56 by the increase of the hydraulic pressure within third lock hole 56. The lock of second vane rotor 23 with respect to first vane rotor 10 is released. However, the hydraulic pressure is not supplied to second lock hole 44. Accordingly, second lock pin 43 is held to be engaged with second lock hole 44.

Figure 25:
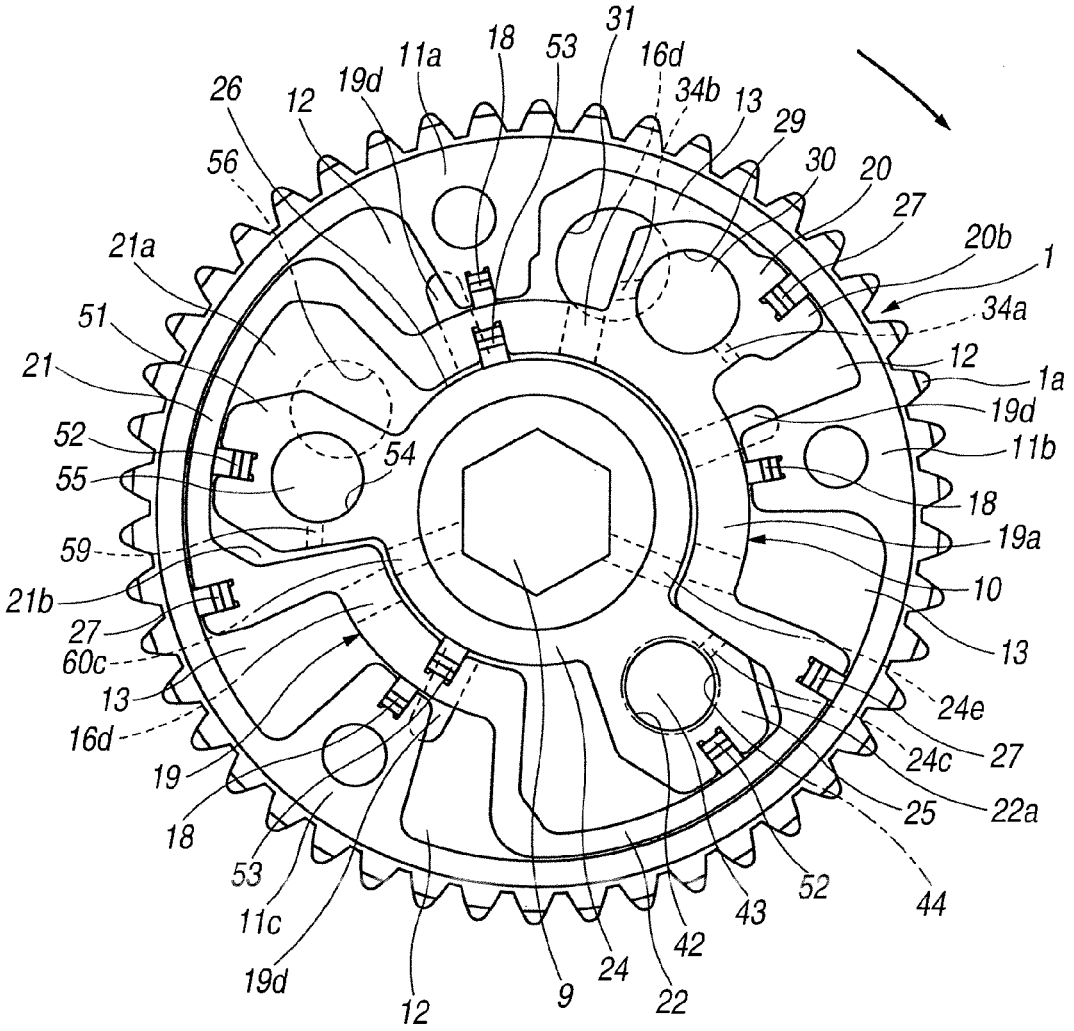
FIG. 25 is a view for illustrating an operation in a state in which the second vane rotor is shifted to the retard angle side in the most advance angle side of the first vane rotor in the variable valve actuating apparatus according to the third embodiment.

Accordingly, as shown in FIG. 25, first vane rotor 10 is rotated in the clockwise direction, and rotated on the advance angle side relative to housing 8. However, second vane rotor 23 is locked by second lock mechanism 41, so that the free relative rotation of second vane rotor 23 relative to housing 8 is restricted. Second vane rotor 23 is held at the rotational position on the most retard angle side.

Accordingly, the only outer cam shaft 5 is relatively rotated on the advance angle side, and inner cam shaft 6 is held at the relative rotational position on the retard angle side. Consequently, first drive cam 5*a* and second drive cam 5*b* become the open angle state.

Accordingly, as to the opening/closing timing characteristic of the one of the intake valves, two drive cams 5*a* and 6*a* press the valve lifter during a time period longer than a time period during which two drive cams 5*a* and 6*a* press the valve lifter at the initial phase and so on, as shown in FIG. 19, like the second embodiment. That is, the time period during which the one of the intake valves is opened is lengthened. The filling time period of the intake air amount is continuously increased. Accordingly, it is possible to ensure the sufficient air amount. Consequently, it is possible to sufficiently increase the output torque of the engine.

As described above, this third embodiment has the structure identical to that of the second embodiment. Accordingly, it is possible to obtain the function and the effect of the simplification of the structure of the hydraulic passages and so on which are identical to those of the first embodiment. Moreover, second vane rotor 23 is arranged in parallel within first vane rotor 10 through second and third vanes 21 and 22 of first vane rotor 10. Accordingly, it is possible to decrease the axial length of the apparatus. Consequently, it is possible to decrease the size of the apparatus, and to improve the mountability to the engine.

In particular, in this third embodiment, the alternating torque acted to cam shafts 5 and 6 are not used unlike the second embodiment. Third lock mechanism 50 locks (connects) first vane rotor 10 and second vane rotor 23. With this, second vane rotor 23 is relatively rotated in the same direction as the rotational direction of first vane rotor 10 in synchronism with the rotation of first vane rotor 10. Moreover, first vane rotor 10 and second vane rotor 23 are relatively rotated independently of each other by releasing the lock by third lock mechanism 50. Accordingly, it is possible to continuously perform the relative rotational position shift and the opening angle (operation angle) enlargement control at the high accuracy.

Moreover, the lock control and the lock release control of first vane rotor 10 and second vane rotor 23 by the above-described third lock mechanism 50 can be arbitrarily performed by the control unit in accordance with the variation of the driving state of the engine.

[Fourth Embodiment]

Figure 26:
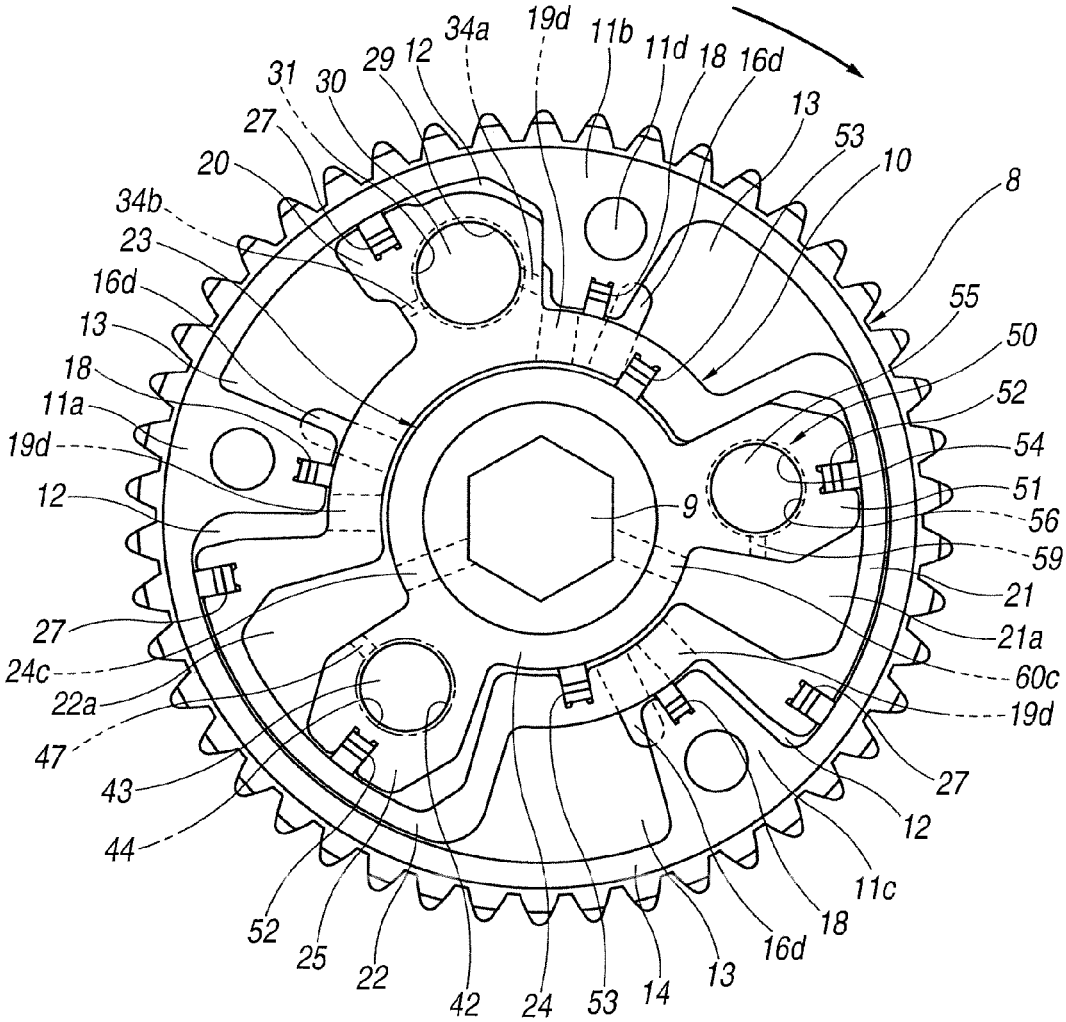
FIG. 26 is for illustrating an operation in a state in which the first vane rotor and the second vane rotor are relatively rotated on the advance angle side, in a variable valve actuating apparatus according to a fourth embodiment of the present invention.
Figure 27:
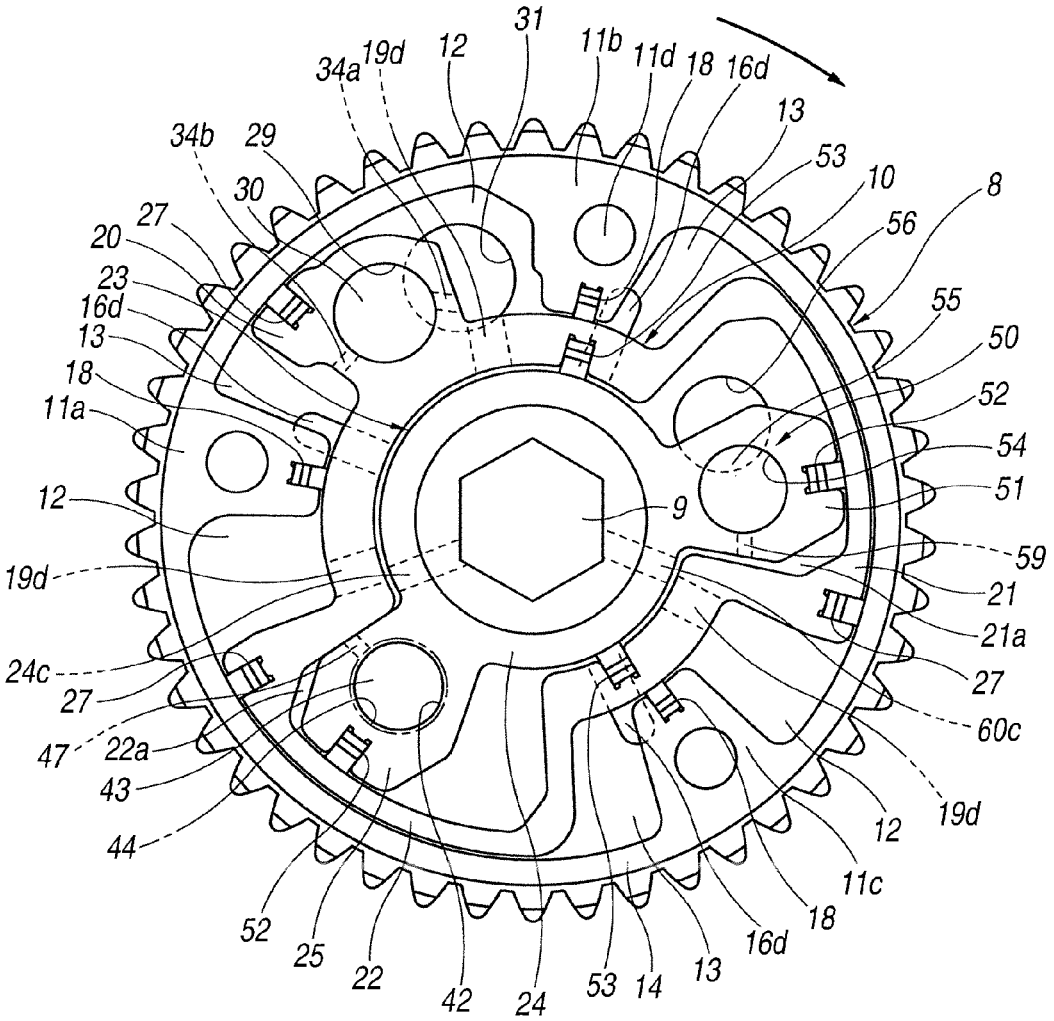
FIG. 27 is a view for illustrating an operation in a state in which the first vane rotor is relatively rotated and shifted to the retard angle side and the second rotor is shifted to the advance angle side, in the variable valve actuating apparatus according to a fourth embodiment of the present invention.
Figure 28:
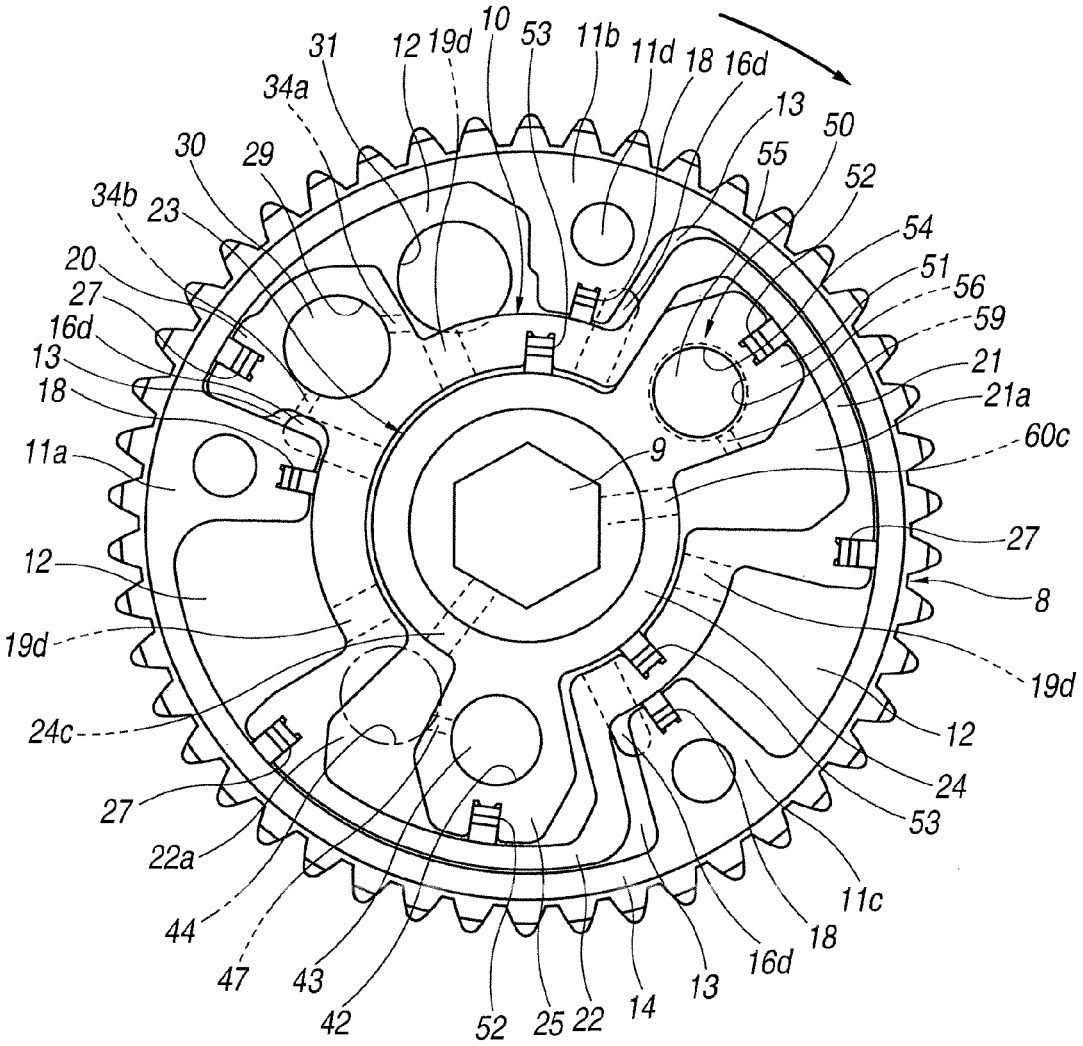
FIG. 28 is an operation illustrative view showing a view for illustrating an operation in a state in which the first vane rotor is relatively rotated and shifted to the advance angle side, in the variable valve actuating apparatus according to a fourth embodiment of the present invention.

FIGS. 26-28 show a variable valve actuating apparatus according to a fourth embodiment. In this embodiment, the variable valve actuating apparatus is applied to the exhaust valve side, like the first embodiment.

The basic structure such as the hydraulic pressure circuit and the basic structure including third lock mechanism 50 of the variable valve actuating apparatus according to the fourth embodiment is substantially identical to those of the third embodiment in most aspects shown by the use of the same reference numerals. Unlike the third embodiment, the directions of first and second vane rotors 10 and 23 are opposite to the directions of those in third embodiment.

That is, first vane rotor 10 is provided within housing 8 to be relatively rotated. As shown in FIG. 26, in first vane rotor 10, second vane 21 is formed into the sectorial frame shape having a bottom wall 21*b*, similarly to third vane 22. Second vane 21 includes a sectorial second vane receiving space 21*a* formed within second vane 21. On the other hand, second vane rotor 23 includes fifth vane 51 integrally provided with second vane rotor 23 on the outer circumference of second rotor 24 at the position different from that of fourth vane 25, that is, the position corresponding to second vane receiving space 21*a*. This fifth vane 51 is received within second vane receiving space 21*a* to be rotated relative to first vane rotor 10.

Two seal members 52 and 52 are mounted and fixed, respectively, in mounting grooves formed on outer circumference surfaces of fourth vane 25 and fifth vane 51. Seal members 52 and 52 are slidably abutted on the inner circumference surfaces of the corresponding second vane 21 and the corresponding third vane 22. On the other hand, two seal members 53 and 53 are mounted and fixed in mounting grooves formed on the inner circumference surface of first rotor 19 at predetermined positions. These seal members 53 and 53 are slidably abutted on the outer circumference surface of second rotor 24. These seal members 52 and 53 shut off the connection between vane receiving spaces 21*a* and 22*a*, and the connection between receiving spaces 21*a* and 22*a*, and rotor receiving space 19*c*.

Between fifth vane 51 and first vane rotor 10, there is provided third lock mechanism 50 arranged to lock between first vane rotor 10 and second vane rotor 23, and to release the lock between first vane rotor 10 and second vane rotor 23.

This third lock mechanism 50 includes third sliding hole 54 formed within fifth vane 51 in the axial direction; third lock pin 55 which is slidably received within third sliding hole 54, and which is arranged to be moved into and away from bottom wall 21*b* of second vane 21; third lock hole 56 which is formed in the bottom surface of bottom wall 21*b* of second vane 21, and with which third lock pin 55 is arranged to be engaged to lock second vane rotor 23 with respect to first vane rotor 10; and the third engagement/release mechanism arranged to engage tip end portion 55*a* of third lock pin 55 with third lock hole 56, and to release the lock between tip end portion 55*a* of third lock pin 55 and third lock hole 56.

The concrete structure of this third lock mechanism 50 is identical to that of FIG. 22. Moreover, release hydraulic pressure circuit 58 is identical to that of the third embodiment shown in FIG. 20. Accordingly, the illustrations are omitted.

[Function of Fourth Embodiment]

First, at the start of the engine, tip end portion 30*a* of first lock pin 30 is previously engaged with first lock hole 31, as shown in FIG. 26. Tip end portion 43*a* of second lock pin 43 and tip end portion 55*a* of third lock pin 55 are engaged, respectively, with the corresponding second lock hole 44 and the corresponding third lock hole 56.

That is, first vane rotor 10 is locked at the relative rotational position on the most advance angle side which is optimal for the start relative to sprocket 1 (housing 8). On the other hand, second vane rotor 23 is also locked by second lock pin 43 at the relative rotational position on the most advance side relative to housing 8. Moreover, first vane rotor 10 and second vane rotor 23 are locked with each other by third lock pin 55.

Accordingly, two drive cams 5*a* and 6*a* become the same rotational phase through outer cam shaft 5 and inner cam shaft 6. The opening/closing timing characteristic of the one of the exhaust valves is held to the phase on the advance angle side as shown by the bold solid line of FIG. 11, like the first embodiment.

Accordingly, it is possible to obtain the good start performance by the smooth cranking when the ignition switch is switched to the ON state in the above-described state.

When the driving state is varied to the predetermined driving state after the start of the engine, the control current is outputted from the control unit, for example, to both first electromagnetic switching valve 38 and third electromagnetic switching valve 61. With this, discharge passage 39*a* of oil pump 39 is connected to retard side passage 37, and drain passage 40 is connected to advance side passage 36. On the other hand, discharge passage 39*a* and release passage 60 of third lock mechanism 50 are connected with each other.

Moreover, at this time, the control current is not outputted to second electromagnetic switching valve 49. Accordingly, release passage 48 is held to be connected to drain passage 40. Consequently, second lock pin 43 is maintained to be engaged with second lock hole 44. First vane rotor 10 and second vane rotor 23 can be relatively rotated independently of each other (First vane rotor 10 and second vane rotor 23 are in a state in which first vane rotor 10 and second vane rotor 23 can be relatively independently rotated (be relatively rotated independently of each other).

Accordingly, retard fluid pressure chambers 12 become the high pressure, and advance fluid pressure chambers 13 become the low pressure. The hydraulic pressure within the one of the retard fluid pressure chambers 12 is supplied to first lock hole 31, so that the lock by first lock pin 30 is released so as to allow the relative rotation of first vane rotor 10. Accordingly, as shown in FIG. 27, first vane rotor 10 is rotated in the counterclockwise direction, and rotated on the retard angle side relative to (with respect to) housing 8.

On the other hand, the pump discharge pressure supplied through release passage 60 to vane receiving space 21*a* is supplied from third oil hole 59 to third lock hole 56. Accordingly, third lock pin 55 is moved in the backward direction by the hydraulic pressure acted on pressure receiving surface 55*c*. With this, third lock pin 55 is moved away from (out of) (dropped out of, come away from) third lock hole 56, so that the lock between first vane rotor 10 and second vane rotor 23 is released. Moreover, at this time, second lock pin 43 is engaged with second lock hole 44 so that the lock state of second vane rotor 23 relative to (with respect to) housing 8 is continued.

Accordingly, as shown in FIG. 27, second vane rotor 23 is held at the relative rotational position on the advance angle side relative to (with respect to) housing 8. On the other hand, the only first vane rotor 10 is positioned at the relative rotational position on the retard angle side.

Consequently, second drive cam 6*a* of inner cam shaft 6 holds the opening and closing timing of the one of the exhaust valves to the position on the advance angle side, similarly to the start of the engine. On the other hand, first drive cam 5*a* of outer cam shaft 5 is controlled to the rotational position on the retard angle side. Accordingly, first drive cam 5*a* becomes the open state with respect to second drive cam 6*a* (first drive cam 5*a* and second drive cam 6*a* become the open state).

Accordingly, as to the opening and closing timing characteristic of the one of the exhaust valves, two drive cams 5*a* and 6*a* press the valve lifter during a time period longer than a time period during which drive cams 5*a* and 6*a* press the valve lifter at the initial phase, as shown in FIG. 12, like the first embodiment. That is, the time period during which the one of the exhaust valves is opened is lengthened (becomes longer), so that the scavenging time period of the combustion gas is continuously increased.

Moreover, when the driving state of the engine is further varied, the control current is outputted from the control unit, for example, to first and second electromagnetic switching valves 38 and 49. With this, discharge passage 39*a* and retard side passage 37 are continuously connected with each other. Discharge passage 39*a* and release passage 48 of second lock mechanism 41 are connected with each other.

Accordingly, the hydraulic fluid discharged from oil pump 39 is similarly supplied through retard side passage 37 to retard fluid pressure chambers 12, so that retard fluid pressure chambers 12 become the high pressure. On the other hand, the hydraulic fluid within advance fluid pressure chambers 13 is drained, so that the advance fluid pressure chambers 13 become the low pressure. Concurrently, the hydraulic fluid is supplied from discharge passage 39*a* through release passage 48 and vane receiving space 22*a* to second lock hole 44. With this, second lock pin 43 is moved in the backward direction, so that the lock between second vane rotor 23 and housing 8 is released.

At this time, the hydraulic pressure within retard fluid pressure chambers 12 is continuously supplied to first lock hole 31. The release state of the lock between first vane rotor 10 and housing 8 by first lock pin 30 is maintained. Accordingly, first vane rotor 10 is further rotated in the counterclockwise direction as shown in FIG. 28, so that outer cam shaft 5 is shifted to the most retard angle side relative to sprocket 1. On the other hand, the lock state between second vane rotor 23 and housing 8 is released since the lock by second lock pin 30 is released. However, third lock pin 55 is engaged with third lock hole 56, so that second vane rotor 23 is locked with first vane rotor 10.

Accordingly, second vane rotor 23 is synchronously rotated on the most retard angle side together with the relative rotation of first vane rotor 10 to the most retard angle side.

Figure 13:
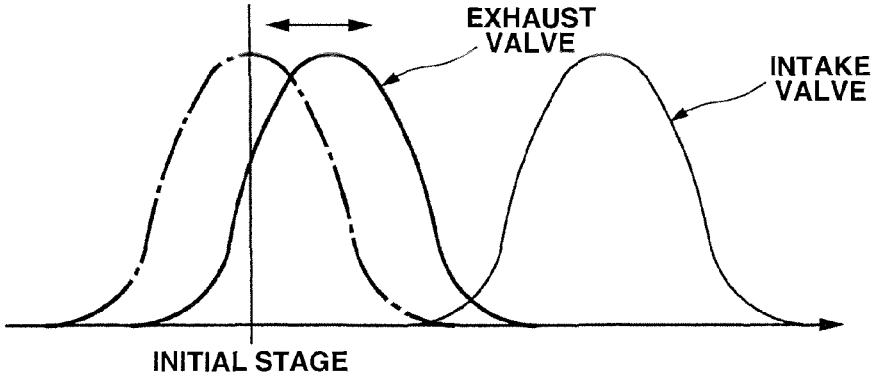
FIG. 13 is a view showing a lift characteristic when the both of the two exhaust valves are shifted together to the phase on the retard angle side.

Therefore, outer cam shaft 5 and inner cam shaft 6 become the same phase. The entire of the opening/closing timing characteristic of the exhaust valve by drive cams 5*a* and 6*a* is controlled to the retard angle side, as shown in FIG. 13.

Besides, in this state, when the energization from the control unit to first electromagnetic switching valve 38 is shut off, the hydraulic fluid within retard fluid pressure chambers 12 is drained. On the other hand, the hydraulic fluid is supplied to advance fluid pressure chambers 13, first vane rotor 10 is relatively rotated on the advance angle side, and concurrently vane rotor 23 is rotated on the advance angle side together with first vane rotor 10. Accordingly, outer cam shaft 5 and inner cam shaft 6 are concurrently continuously rotated relatively in the same direction.

In this way, in the fourth embodiment, it is possible to attain the functions and effects such as the size reduction of the apparatus which is identical to those of the third embodiment.

The present invention is not limited to the structure and the control function of the embodiments. It is possible to perform a control to arbitrarily lock first vane rotor 10 and second vane rotor 23 in accordance with the engine driving state or to arbitrarily release the lock between first vane rotor 10 and second vane rotor 23 in accordance with the engine driving state.

In the embodiments, two drive cams 5*a* and 6*a* are used in one exhaust valve and one intake valve. However, drive cams 5*a* and drive cam 6*a* may independently open and close, respectively, two exhaust valves and two intake valves of one cylinder, and moreover control to the open angle state.

Moreover, the first rotary member and the second rotary member are not limited to the vane rotor. For example, a plurality of gears may be used as the first rotary member and the second rotary member, in place of the vane rotor.

Moreover, the lock release of the first rotary member with respect to the drive rotary member, and the lock release between the first rotary member and the second rotary member may be performed by an electric means such as an electric motor, in place of the hydraulic pressure.

[a1] In the variable valve actuating apparatus according to the embodiments of the present invention, the receiving chamber includes an opening portion formed on an axial one end side of the first rotary member.

[b1] In the variable valve actuating apparatus according to the embodiments of the present invention, the second rotary member is received within the receiving chamber; and the second rotary member includes a rotor fixed to the other of the inner cam shaft and the outer cam shaft, and a vane which protrudes from an outer circumference of the rotor, and which is arranged to be pivoted within the receiving chamber in a circumferential direction.

[c1] In the variable valve actuating apparatus according to the embodiments of the present invention, the vane of the second rotary member are received within the receiving chamber formed in one of the vanes of the first rotary member.

[d1] In the variable valve actuating apparatus according to the embodiments of the present invention, the rotor of the second rotary member is fixed on the inner cam shaft; and the rotor of the first rotary member is fixed on the outer cam shaft.

[e1] In the variable valve actuating apparatus according to the embodiments of the present invention, the variable valve actuating apparatus further comprises a second lock mechanism arranged to lock a relative rotation between the drive rotary member and the second rotary member, and release the lock of the relative rotation between the drive rotary member and the second rotary member.

[f1] In the variable valve actuating apparatus according to the embodiments of the present invention, the second rotary member receives a rotational torque in the retard angle direction relative to the first rotary member at least while the drive rotary member is rotated.

[g1] In the variable valve actuating apparatus according to the embodiments of the present invention, the second lock mechanism is locked at a relative rotational position at which the first rotary member is positioned on the most advance angle position with respect to the drive rotary member, and the second rotary member is positioned on the most retard angle position with respect to the first rotary member.

[h1] In the variable valve actuating apparatus according to the embodiments of the present invention, the second lock mechanism is arranged to be actuated by a hydraulic pressure independently from of the hydraulic pressure supplied to the advance angle operation chambers and the retard angle operation chambers.

[i1] In the variable valve actuating apparatus according to the embodiments of the present invention, the variable valve actuating apparatus further comprises a first lock mechanism arranged to lock a relative rotation between the drive rotary member and the first rotary member, and to release the lock of the relative rotation between the drive rotary member and the first rotary member, at a relative rotational position at which the first rotary member is positioned at a most advance angle position or a most retard angle position with respect to the drive rotary member.

[j1] In the variable valve actuating apparatus according to the embodiments of the present invention, the inner cam and the outer cam are arranged to drive an exhaust valve of the same cylinder; and the first lock mechanism is arranged to lock the first rotary member when the first rotary member is positioned at the most retard angle position with respect to the drive rotary member.

[k1] In the variable valve actuating apparatus according to the embodiments of the present invention, the inner cam and the outer cam are arranged to drive an intake valve of the same cylinder; and the first lock mechanism is arranged to lock the first rotary member when the first rotary member is positioned at the most retard angle position with respect to the drive rotary member.

[l1] In the variable valve actuating apparatus according to the embodiments of the present invention, the variable valve actuating apparatus further comprises a third lock mechanism arranged to lock a relative rotation between the first rotary member and the second rotary member, and to release the lock of the relative rotation between the first rotary member and the second rotary member.

[m1] In the variable valve actuating apparatus according to the embodiments of the present invention, the third lock mechanism is arranged to lock the relative rotation between the first rotary member and the second rotary member or release the lock of the relative rotation between the first rotary member and the second rotary member when the second rotary member is positioned at a most advance angle position or a most retard angle position relative to the first rotary member.

[n1] In the variable valve actuating apparatus according to the embodiments of the present invention, the third lock mechanism is arranged to lock the relative rotation between the first rotary member and the second rotary member when the second rotary member is positioned, with respect to the first rotary member, in a direction opposite to a side on which the first rotary member is locked by the first lock mechanism with respect to the drive rotary member.

A variable valve actuating apparatus for an internal combustion engine according to the embodiments of the present invention, the variable valve actuating apparatus includes: an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force is transmitted from a crank shaft, and which includes an operation chamber formed within the drive rotary member; a first rotary member including a rotor fixed to one of the inner cam shaft and the outer cam shaft, vanes separating the operation chamber to an advance angle operation chamber and a retard angle operation chamber, the first rotary member being arranged to be rotated in an advance angle direction or in a retard angle direction relative to the drive rotary member by a hydraulic pressure selectively supplied to or drained from the advance angle operation chamber and the retard angle operation chamber; a second rotary member which is fixed to the other of the inner cam shaft and the outer cam shaft, which is arranged to be rotated relative to the first rotary member within a predetermined range, the second rotary member constantly receiving a variation torque in the retard angle direction relative to the first rotary member at least while the drive rotary member is rotated; and a lock mechanism arranged to lock a relative rotation between the drive rotary member and the second rotary member in accordance with a request, at a position at which the first rotary member is rotated a predetermined angle on the advance angle side relative to the drive rotary member, and at which the second rotary member is positioned at the relative rotational position on the most retard angle relative to the first rotary member.

A variable valve actuating apparatus for an internal combustion engine according to the embodiments of the present invention, the variable valve actuating apparatus includes: an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force from a crank shaft is transmitted; a first rotary member which is fixed to one of the inner cam shaft and the outer cam shaft, which is arranged to be rotated on the advance angle side or the retard angle side with respect to the drive rotary member within a predetermined angle range, and to be rotated on the advance angle side or the retard angle side with respect to the drive rotary member by the hydraulic pressure; a second rotary member which is fixed to the other of the inner cam shaft and the outer cam shaft, which is arranged to be rotated within a predetermined angle range relative to the first rotary member, and to which a variation torque in the retard side direction or the advance angle direction with respect to the first rotary member is acted at least while the drive rotary member is driven and rotated; and a lock mechanism arranged to lock a relative rotation between the drive rotary member and the second rotary member at a predetermined angle position except for a position at which the first rotary member is furthest rotated relative to the drive rotary member, and a position at which the second rotary member is furthest rotated relative to the first rotary member in the alternating torque direction, in accordance with a request, and to release the lock of the relative rotation between the drive rotary member and the second rotary member at a predetermined angle position except for a position at which the first rotary member is furthest rotated relative to the drive rotary member, and a position at which the second rotary member is furthest rotated relative to the first rotary member in the alternating torque direction, in accordance with the request.

A variable valve actuating apparatus for an internal combustion engine according to the embodiments of the present invention, the variable valve actuating apparatus includes: an inner cam shaft including an inner cam formed on an outer circumference thereof; an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam; a drive rotary member to which a rotational force from a crank shaft is transmitted; a first rotary member fixed to one of the inner cam shaft and the outer cam shaft; a second rotary member fixed to the other of the inner cam shaft and the outer cam shaft, which is arranged to be rotated within a predetermined angle range relative to the drive rotary member and the first rotary member, and to which a variation torque in a retard angle direction or in an advance angle direction with respect to the first rotary member is constantly acted at least while the drive rotary member is driven and rotated; and a lock mechanism arranged to lock a relative rotation of the drive rotary member and the second rotary member in accordance with a request, and to release the relative rotation of the drive rotary member and the second rotary member in accordance with the request, the first rotary member being arranged to be rotated in the retard angle direction and the advance angle direction with respect to the drive rotary member when the second rotary member is locked by the lock mechanism.

[a2] In the variable valve actuating apparatus according to the embodiments of the present invention, the lock mechanism is arranged to lock the second rotary member when the first rotary member is positioned at a most advance angle position relative to the drive rotary member, and the second rotary member is positioned at the most retard angle position relative to the first rotary member.

[b2] In the variable valve actuating apparatus according to the embodiments of the present invention, the lock mechanism is arranged to be actuated in a release direction by a hydraulic pressure which is different and independent from a hydraulic pressure which is supplied to the advance operation chambers or the retard operation chambers.

[c2] In the variable valve actuating apparatus according to the embodiments of the present invention, the variable valve actuating apparatus further includes a first lock mechanism arranged to lock a relative rotation between the drive rotary member and the first rotary member when the first rotary member is positioned at the most advance angle position or the most retard angle position relative to (with respect to) the drive rotary member; and the first lock mechanism is arranged to be actuated by the hydraulic pressure by which the first rotary member is rotated on the retard angle side or the advance angle side relative to the drive rotary member.

[d2] In the variable valve actuating apparatus according to the embodiments of the present invention, the inner cam and the outer cam are arranged to drive the a pair of the exhaust valves of the same cylinder; and the first lock mechanism is arranged to lock the first rotary member at the most advance angle position relative to the drive rotary member.

[e2] In the variable valve actuating apparatus according to the embodiments of the present invention, the inner cam and the outer cam is rotated by the same phase when the second rotary member is positioned at the most retard angle position relative to the first rotary member.

[f2] In the variable valve actuating apparatus according to the embodiments of the present invention, one of the inner cam and the outer cam is rotated on the retard angle side relative to the other of the inner cam and the outer cam when the second rotary member is rotated in the advance angle direction relative to the first rotary member.

[g2] In the variable valve actuating apparatus according to the embodiments of the present invention, the inner cam and the outer cam are arranged to drive a pair of the intake valves of the same cylinder; and the first lock mechanism is arranged to lock the first rotary member at the most retard angle position relative to the drive rotary member.

[h2] In the variable valve actuating apparatus according to the embodiments of the present invention, the inner cam and the outer cam are rotated by the same phase when the second rotary member is positioned at the most retard angle position relative to the first rotary member.

[i2] In the variable valve actuating apparatus according to the embodiments of the present invention, one of the inner cam and the outer cam is rotated on the advance angle side relative to the other of the inner cam and the outer cam when the second rotary member is rotated on the retard angle side relative to the first rotary member.

[j2] In the variable valve actuating apparatus according to the embodiments of the present invention, the second rotary member is received in a receiving chamber formed in the first rotary member.

[k2] In the variable valve actuating apparatus according to the embodiments of the present invention, the second rotary member includes a rotor fixed to the other of the inner cam shaft and the outer cam shaft, and a vane rotated within the receiving chamber in the circumferential direction; and the lock mechanism is provided in the vane of the second rotary member.

[l2] In the variable valve actuating apparatus according to the embodiments of the present invention, the vane of the second rotary member is received within the receiving chamber formed in the vane of the first rotary member.

[m2] In the variable valve actuating apparatus according to the embodiments of the present invention, an outer circumference of the vane of the second rotary member is not abutted on an inner circumference of the receiving chamber; and the hydraulic fluid is filled within the receiving chamber.

[n2] In the variable valve actuating apparatus according to the embodiments of the present invention, the rotor of the second rotary member is fixed on the inner cam shaft; and the rotor of the first rotary member is fixed on the outer cam shaft.

The entire contents of Japanese Patent Application No. 2012-100516 filed Apr. 26, 2012 and Japanese Patent Application No. 2012-128513 filed Jun. 6, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve actuating apparatus for an internal combustion engine, the variable valve actuating apparatus comprising:

an inner cam shaft including an inner cam formed on an outer circumference thereof;

an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam;

a drive rotary member to which a rotational force is transmitted from a crank shaft, and which includes an operation chamber formed within the drive rotary member;

a first rotary member which includes a rotor fixed to one of the inner cam shaft and the outer cam shaft, vanes separating the operation chamber into an advance angle operation chamber and a retard angle operation chamber, and a receiving chamber formed within the first rotary member, and which is arranged to be rotated in an advance angle direction or in a retard angle direction relative to the drive rotary member by a hydraulic pressure selectively supplied to or drained from the advance angle operation chamber and the retard angle operation chamber; and a second rotary member fixed to the other of the inner cam shaft and the outer cam shaft, rotatably received within the receiving chamber of the first rotary member, and arranged to be rotated relative to the first rotary member and the drive rotary member within a predetermined angle range.

2. The variable valve actuating apparatus as claimed in claim 1, wherein the receiving chamber includes an opening portion formed on an axial end side of the first rotary member.

3. The variable valve actuating apparatus as claimed in claim 2, wherein the second rotary member is received within the receiving chamber; and the second rotary member includes a rotor fixed to the other of the inner cam shaft and the outer cam shaft, and a vane which protrudes from an outer circumference of the rotor, and which is arranged to be pivoted within the receiving chamber in a circumferential direction.

4. The variable valve actuating apparatus as claimed in claim 3, wherein the vane of the second rotary member is received within the receiving chamber formed within the first rotary member.

5. The variable valve actuating apparatus as claimed in claim 3, wherein the rotor of the second rotary member is fixed on the inner cam shaft; and the rotor of the first rotary member is fixed on the outer cam shaft.

6. The variable valve actuating apparatus as claimed in claim 1, wherein the variable valve actuating apparatus further comprises a second lock mechanism arranged to lock a relative rotation between the drive rotary member and the second rotary member, and to release the lock of the relative rotation between the drive rotary member and the second rotary member.

7. The variable valve actuating apparatus as claimed in claim 6, wherein the second rotary member receives a rotational torque in the retard angle direction relative to the first rotary member at least while the drive rotary member is rotated.

8. The variable valve actuating apparatus as claimed in claim 6, wherein the second lock mechanism is locked at a relative rotational position at which the first rotary member is positioned on a most advanced angle position with respect to the drive rotary member, and the second rotary member is positioned on a most retarded angle position with respect to the first rotary member.

9. The variable valve actuating apparatus as claimed in claim 6, wherein the second lock mechanism is arranged to be actuated by a hydraulic pressure independently from the hydraulic pressure supplied to the advance angle operation chamber and the retard angle operation chamber.

10. The variable valve actuating apparatus as claimed in claim 1, wherein the variable valve actuating apparatus further comprises a first lock mechanism arranged to lock a relative rotation between the drive rotary member and the first rotary member, and to release the lock of the relative rotation between the drive rotary member and the first rotary member, at a relative rotational position at which the first rotary member is positioned at a most advanced angle position or a most retarded angle position with respect to the drive rotary member.

11. The variable valve actuating apparatus as claimed in claim 10, wherein the inner cam and the outer cam are arranged to drive an exhaust valve of a same cylinder; and the first lock mechanism is arranged to lock the first rotary member when the first rotary member is positioned at the most retarded angle position with respect to the drive rotary member.

12. The variable valve actuating apparatus as claimed in claim 10, wherein the inner cam and the outer cam are arranged to drive an intake valve of a same cylinder; and the first lock mechanism is arranged to lock the first rotary member when the first rotary member is positioned at the most retarded angle position with respect to the drive rotary member.

13. The variable valve actuating apparatus as claimed in claim 1, wherein the variable valve actuating apparatus further comprises a third lock mechanism arranged to lock a relative rotation between the first rotary member and the second rotary member, and to release the lock of the relative rotation between the first rotary member and the second rotary member.

14. The variable valve actuating apparatus as claimed in claim 1, wherein the third lock mechanism is arranged to lock the relative rotation between the first rotary member and the second rotary member or release the lock of the relative rotation between the first rotary member and the second rotary member when the second rotary member is positioned at a most advanced angle position or a most retarded angle position relative to the first rotary member.

15. A variable valve actuating apparatus for an internal combustion engine, the variable valve actuating apparatus comprising:

an inner cam shaft including an inner cam formed on an outer circumference thereof;

an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam;

a drive rotary member to which a rotational force is transmitted from a crank shaft;

a first rotary member fixed to one of the inner cam shaft and the outer cam shaft, arranged to be rotated relative to the drive rotary member, and to be rotated by a hydraulic pressure relative to the drive rotary member in an advance angle direction or in a retard angle direction; and a second rotary member fixed to the other of the inner cam shaft and the outer cam shaft, and arranged to be rotated relative to the drive rotary member and the first rotary member within a predetermined angle range.

16. A variable valve actuating apparatus for an internal combustion engine, the variable valve actuating apparatus comprising:

an inner cam shaft including an inner cam formed on an outer circumference thereof;

an outer cam shaft which is provided on the outer circumference of the inner cam shaft, which includes an outer cam provided radially outside the outer cam shaft, the outer cam shaft and the inner cam shaft being arranged to be relatively rotated so as to vary a relative rotational phase of the outer cam with respect to the inner cam;

a drive rotary member to which a rotational force is transmitted from a crank shaft;

a first rotary member which is fixed to one of the inner cam shaft and the outer cam shaft, which is arranged to be rotated relative to the drive rotary member, and to be rotated relative to the drive rotary member in an advance angle direction or in a retard angle direction, and which includes a receiving chamber formed within the first rotary member; and a second rotary member fixed to the other of the inner cam shaft and the outer cam shaft, rotatably received within the receiving chamber, and arranged to be in a state where a relative rotation of the second rotary member is fixed to the drive rotary member, and arranged to be relatively rotated together with the first rotary member relative to the drive rotary member.

* * * * *